US009955832B2

(12) United States Patent
Thorne et al.

(10) Patent No.: US 9,955,832 B2
(45) Date of Patent: May 1, 2018

(54) SURFACE CLEANING HEAD WITH REMOVABLE NON-DRIVEN AGITATOR HAVING CLEANING PAD

(71) Applicant: SHARKNINJA OPERATING LLC, Newton, MA (US)

(72) Inventors: Jason B. Thorne, Wellesley Hills, MA (US); Kai Xu, Suzhou (CN); AiMing Xu, Suzhou (CN); Andre David Brown, North Curry (GB); Brian Burke, Barrington, RI (US); Michael D'Amico, Mansfield, MA (US); Peter Hutchinson, Suzhou (CN)

(73) Assignee: SharkNinja Operating LLC, Needham, MA (US)

( * ) Notice: Subject to any disclaimer, the term of this patent is extended or adjusted under 35 U.S.C. 154(b) by 310 days.

(21) Appl. No.: 14/867,599

(22) Filed: Sep. 28, 2015

(65) Prior Publication Data

US 2016/0220082 A1 Aug. 4, 2016

Related U.S. Application Data

(63) Continuation-in-part of application No. 14/739,915, filed on Jun. 15, 2015, now Pat. No. 9,456,723.
(Continued)

(51) Int. Cl.
*A47L 9/04* (2006.01)
*A47L 9/06* (2006.01)
(Continued)

(52) U.S. Cl.
CPC ..... *A47L 9/0455* (2013.01); *A47L 5/30* (2013.01); *A47L 9/02* (2013.01); *A47L 9/0444* (2013.01); *A47L 9/0477* (2013.01)

(58) Field of Classification Search
CPC ..... A47L 9/02; A47L 9/0444; A47L 9/0455; A47L 9/0477; A47L 5/30; A47L 9/04; A47L 9/06
See application file for complete search history.

(56) References Cited

U.S. PATENT DOCUMENTS 2,411,488 A 11/1946 White
2,707,792 A 5/1955 Waller
(Continued)

FOREIGN PATENT DOCUMENTS

DE 102012207357 A1 11/2013
EP 0909547 A2 4/1999
(Continued)

OTHER PUBLICATIONS

U.S. Office Action dated Feb. 22, 2016, received in related U.S. Appl. No. 14/744,438, 29 pgs.
(Continued)

*Primary Examiner* — David Redding
(74) *Attorney, Agent, or Firm* — Grossman Tucker Perreault & Pfleger, PLLC

(57) ABSTRACT

A surface cleaning head may be configured to receive a removable rotatable driven agitator, such as a brush roll, or a non-driven agitator. Either of these agitators may be located in an openable agitator chamber for purposes of removing debris and/or removing the agitator. The openable agitator chamber may be covered by an external cover that is movable between an open position and a closed position. The non-driven agitator may include an agitator body including a bottom portion supporting one or more cleaning pads. The non-driven agitator body may also define one or more air inlets, an air outlet and an air passageway extending therebetween to facilitate air passage through the surface cleaning head. Different removable agitators with different
(Continued)

characteristics may be used interchangeably in the surface cleaning head.

29 Claims, 16 Drawing Sheets

Related U.S. Application Data

(60) Provisional application No. 62/110,232, filed on Jan. 30, 2015.

(51) Int. Cl.
*A47L 5/30* (2006.01)
*A47L 9/02* (2006.01)

(56) References Cited

U.S. PATENT DOCUMENTS

| | | | |
|---|---|---|---|
| 2,785,431 | A | 3/1957 | Pardee |
| 2,910,721 | A | 11/1959 | Burrage |
| 3,643,276 | A | 2/1972 | Worwag |
| 4,173,807 | A | 11/1979 | Maier |
| 4,333,205 | A | 6/1982 | Woodward et al. |
| 4,372,004 | A | 2/1983 | Vermillion |
| 4,429,430 | A | 2/1984 | Lyman |
| 4,662,027 | A | 5/1987 | Parker et al. |
| 4,866,804 | A | 9/1989 | Masbruch et al. |
| 4,980,945 | A | 1/1991 | Bewley |
| 5,014,387 | A | 5/1991 | Hays |
| 5,309,601 | A | 5/1994 | Hampton et al. |
| 5,452,490 | A | 9/1995 | Brundula et al. |
| 5,495,634 | A | 3/1996 | Brundula et al. |
| 5,632,060 | A | 5/1997 | Steinberg et al. |
| 5,659,919 | A | 8/1997 | Kajihara |
| 5,765,258 | A | 6/1998 | Melito et al. |
| 5,799,364 | A | 9/1998 | Foisy et al. |
| 5,960,514 | A | 10/1999 | Miller et al. |
| 6,012,200 | A | 1/2000 | Murphy et al. |
| 6,226,832 | B1 | 5/2001 | McCormick |
| 6,324,714 | B1 | 12/2001 | Walz et al. |
| 6,513,190 | B1 | 2/2003 | Allgeier et al. |
| 6,539,575 | B1 | 4/2003 | Cohen |
| 6,550,099 | B2 | 4/2003 | Worwag |
| 7,013,528 | B2 | 3/2006 | Parker et al. |
| 7,200,893 | B2 | 4/2007 | Gerber et al. |
| 7,316,050 | B2 | 1/2008 | Worwag |
| 7,329,294 | B2 | 2/2008 | Conrad |
| 7,690,079 | B2 | 4/2010 | Boddy et al. |
| 7,987,546 | B2 | 8/2011 | Poch et al. |
| 8,037,571 | B2 | 10/2011 | Butts et al. |
| 8,316,503 | B2 | 11/2012 | Follows et al. |
| 8,402,601 | B2 | 3/2013 | Fahlstrom |
| 8,434,194 | B2 | 5/2013 | Jeong et al. |
| 8,533,904 | B2 | 9/2013 | Conrad |
| 8,631,541 | B2 | 1/2014 | Tran |
| 8,720,001 | B2 | 5/2014 | Courtney et al. |
| 8,726,441 | B1 | 5/2014 | Colasanti et al. |
| 8,776,311 | B2 | 7/2014 | Genn et al. |
| 8,782,851 | B2 | 7/2014 | Follows et al. |
| 8,800,107 | B2 | 8/2014 | Blouin |
| 8,806,710 | B2 | 8/2014 | Follows et al. |
| 2002/0092122 | A1 | 7/2002 | Zahuranec et al. |
| 2003/0106183 | A1 | 6/2003 | Frederick et al. |
| 2003/0145424 | A1 | 8/2003 | Stephens et al. |
| 2003/0159240 | A1 | 8/2003 | Mertes et al. |
| 2004/0045125 | A1 | 3/2004 | Park et al. |
| 2006/0272122 | A1 | 12/2006 | Butler et al. |
| 2008/0052846 | A1 | 3/2008 | Kapoor et al. |
| 2010/0306958 | A1 | 12/2010 | Follows et al. |
| 2011/0296648 | A1 | 12/2011 | Kah, Jr. |
| 2012/0311802 | A1 | 12/2012 | Hinnant |
| 2013/0198995 | A1 | 8/2013 | Eriksson |
| 2013/0212831 | A1 | 8/2013 | Follows et al. |
| 2014/0259521 | A1 | 9/2014 | Kowalski |
| 2014/0331446 | A1 | 11/2014 | Eriksson |
| 2016/0073841 | A1 | 3/2016 | Eriksson |

FOREIGN PATENT DOCUMENTS

| | | | |
|---|---|---|---|
| GB | 583738 | | 12/1946 |
| GB | 2509925 | B | 7/2014 |
| JP | H10201682 | A | 8/1998 |
| JP | 2009045503 | A | 3/2009 |
| JP | 2011050428 | A | 3/2011 |
| WO | 0141618 | A1 | 6/2001 |
| WO | 2013104886 | A1 | 7/2013 |
| WO | 2014131105 | A1 | 9/2014 |
| WO | 2014131106 | A1 | 9/2014 |

OTHER PUBLICATIONS

PCT International Search Report and Written Opinion dated Mar. 31, 2016, received in corresponding PCT Application No. PCT/US16/15370, 15 pgs.

U.S. Office Action dated May 12, 2017, received in related U.S. Appl. No. 14/812,734, 13 pgs.

SURFACE CLEANING HEAD WITH REMOVABLE NON-DRIVEN AGITATOR HAVING CLEANING PAD

CROSS-REFERENCE TO RELATED APPLICATIONS

This application claims the benefit of U.S. Provisional Patent Application Ser. No. 62/110,232, filed on Jan. 30, 2015, which is fully incorporated herein by reference. This application is also a continuation-in-part of U.S. patent application Ser. No. 14/739,915 filed on Jun. 15, 2015, which is fully incorporated herein by reference.

TECHNICAL FIELD

The present invention relates to vacuum cleaners and more particularly, to a vacuum cleaner surface cleaning head with a removable non-driven agitator having one or more cleaning pads.

BACKGROUND INFORMATION

The following is not an admission that anything discussed below is part of the prior art or part of the common general knowledge of a person skilled in the art.

A surface cleaning apparatus, more commonly known as a vacuum cleaner, may be used to clean a variety of surfaces using at least suction. Various types of vacuum cleaners are known including, without limitation, upright vacuum cleaners, canister vacuum cleaners, stick vacuum cleaners and central vacuum systems. A surface cleaning apparatus typically includes a surface cleaning head with an inlet. Some vacuum cleaners include some or all of the operating components (e.g., the suction motor and the air treatment members) at a location other than the surface cleaning head to enable the surface cleaning head to be lighter or smaller. An upright vacuum cleaner, for example, may include an upright section containing at least an air treatment member that is mounted to a surface cleaning head. A canister vacuum cleaner may include a canister body containing at least an air treatment member and a suction motor that is connected to a surface cleaning head by a flexible hose and a handle. Another type of vacuum cleaner includes the suction motor and the air treatment members (e.g., one or more cyclones) positioned in the surface cleaning head.

A surface cleaning apparatus, such as any of the vacuum cleaners mentioned above, may also include one or more mechanical agitators, such as a rotating brush roll, in the surface cleaning head to facilitate cleaning a surface. One problem with mechanical agitators, particularly rotating brush rolls, is the difficulty removing debris (e.g., hair) that becomes entangled. The surface cleaning head often must be turned upside down to determine if the agitator is entangled or clogged and to remove the debris. Removing the debris from the mechanical agitator located inside the surface cleaning head may also be difficult, especially through the limited opening in the bottom of the surface cleaning head. An inability to remove the debris adequately may result in a decrease in performance and even damage to the mechanical agitator and/or vacuum cleaner.

In some conventional vacuum cleaners, the agitator also may not be suitable for all surfaces and/or conditions. A rotating brush roll, for example, may be desirable to provide agitation on a carpet but not on a hard wood floor. This may further limit the performance as well as the versatility of the vacuum cleaner.

SUMMARY

Consistent with an embodiment, a surface cleaning head is provided for a vacuum. The surface cleaning head includes a cleaning head housing having a front end portion, a rear end portion, laterally disposed sides, an upper portion and a bottom portion. An agitator chamber is located in the front end portion of the cleaning head housing. The agitator chamber has a top opening through the upper portion of the cleaning head housing and a bottom opening through the bottom portion of the cleaning head housing and includes at least one driven side. The surface cleaning head also includes an agitator drive mechanism including a drive member at the driven side of the agitator chamber and an agitator drive motor drivingly coupled to the drive member. The drive member is configured to engage and drive a rotatable driven agitator when received in the agitator chamber. An external cover is mounted to the cleaning head housing for covering the top opening of the agitator chamber. The external cover is movable between a closed position and an open position. The agitator chamber is covered when the external cover is in the closed position and accessible through the top opening when the external cover is in the open position. The surface cleaning head further includes a non-driven agitator removably mounted within the agitator chamber without engaging the drive member such that the non-driven agitator is configured to contact a surface through the bottom opening. The non-driven agitator is accessible and removable through the top opening when the external cover is in the open position.

Consistent with another embodiment, a surface cleaning head is provided for a vacuum. The surface cleaning head includes a cleaning head housing having a front end portion, a rear end portion, laterally disposed sides, an upper portion and a bottom portion. An agitator chamber is located in the front end portion of the cleaning head housing. The agitator chamber has a top opening through the upper portion of the cleaning head housing and a bottom opening through the bottom portion of the cleaning head housing and includes at least one driven side. The surface cleaning head also includes an agitator drive mechanism including a drive member at the driven side of the agitator chamber and an agitator drive motor drivingly coupled to the drive member. At least one rotatable driven agitator is configured to be removably mounted within the agitator chamber and configured to engage the drive member of the agitator drive mechanism such that the drive member causes the rotatable driven agitator to rotate. At least one non-driven agitator is configured to be removably mounted within the agitator chamber without engaging the drive member and such that the non-driven agitator is configured to contact a surface through the bottom opening.

Consistent with a further embodiment, a removable non-driven agitator is provided for use in an agitator chamber of a surface cleaning head. The removable non-driven agitator includes an agitator body defining first and second elongated air inlets, an air outlet, and an air path between the at least one air inlet and the air outlet. The elongated air inlets are located along at least a portion of a bottom portion of the agitator body, and the air outlet is located on the agitator body at a position to provide engagement with a dirty air inlet in the agitator chamber of the surface cleaning head. The bottom portion of the agitator body has a width corresponding to a width of a bottom opening of the agitator chamber. First and second ends of the agitator body are configured to engage the agitator chamber without engaging a drive member in the agitator chamber. The removable non-driven agitator also includes at least one cleaning pad supported on a pad support member on at least one side of the bottom portion of the agitator body and a seal around the air outlet.

BRIEF DESCRIPTION OF THE DRAWINGS

These and other features and advantages will be better understood by reading the following detailed description, taken together with the drawings wherein.

Figure 1:
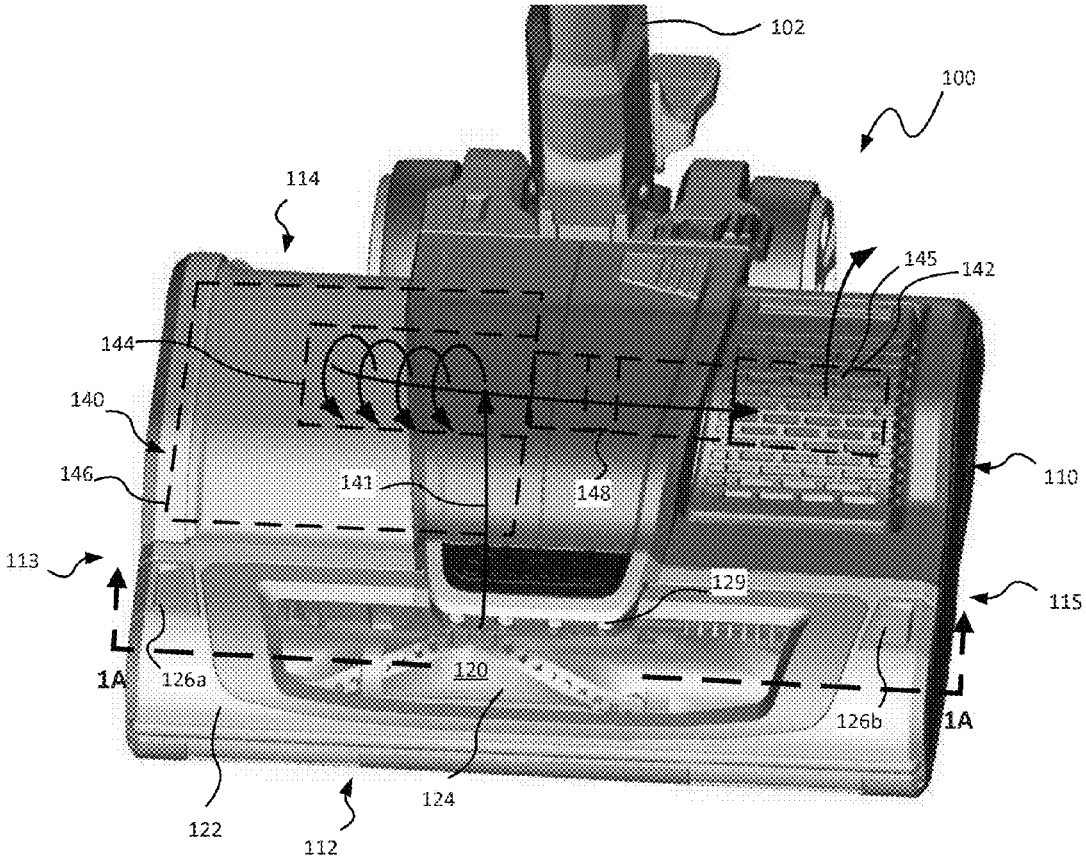
FIG. 1 is a perspective view of a surface cleaning head including an openable agitator chamber covered by an external cover with a transparent region, consistent with an embodiment of the present disclosure.

The drawings included herewith are for illustrating various examples of articles, methods, and apparatuses of the teaching of the present specification and are not intended to limit the scope of what is taught in any way.

DETAILED DESCRIPTION

A surface cleaning head, consistent with embodiments of the present disclosure, may be configured to receive a removable rotatable driven agitator, such as a brush roll, or a non-driven agitator. Either of these agitators may be located in an openable agitator chamber for purposes of removing debris and/or removing the agitator. The openable agitator chamber may be covered by an external cover that is movable between an open position and a closed position. The non-driven agitator may include an agitator body including a bottom portion supporting one or more cleaning pads. The non-driven agitator body may also define one or more air inlets, an air outlet and an air passageway extending therebetween to facilitate air passage through the surface cleaning head. Different removable agitators with different characteristics may be used interchangeably in the surface cleaning head.

In the illustrated embodiments, the openable agitator chamber, external cover, removable rotatable agitator and other features described herein are used in an "all in the head" type vacuum cleaner in which the functional or operational components for the transport and treatment of fluid (e.g., air) are substantially all contained within the surface cleaning head. The openable agitator chamber, external cover, removable rotatable agitator and other features described herein may also be implemented, within the scope of the present disclosure, in a surface cleaning head for any type of surface cleaning apparatus or vacuum including, without limitation, upright vacuum cleaners, canister vacuum cleaners, stick vacuum cleaners, robotic vacuum cleaners and central vacuum systems.

As used herein, a "surface cleaning head" refers to a device configured to contact a surface for cleaning the surface by use of suction air flow, agitation, or a combination thereof. A surface cleaning head may be pivotably or steeringly coupled by a swivel connection to a wand for controlling the surface cleaning head and may include motorized attachments as well as fixed surface cleaning heads. A surface cleaning head may also be operable without a wand or handle. As used herein, "agitator" refers to any element, member or structure capable of agitating a surface to facilitate movement of debris into a suction air flow in a surface cleaning head. As used herein, "transparent" means capable of allowing enough light to pass through so that objects on the other side can be seen.

Referring to FIGS. 1-3A, an embodiment of a surface cleaning head 100 is shown and described in greater detail. As shown in greater detail in FIG. 2, a wand 102 is steeringly coupled by a swivel connection to the surface cleaning head 100 and includes a handle 104 at one end to allow the user to control the surface cleaning head 100 during use. The wand 102 may have a telescoping configuration to provide length adjustment. The handle 104 may include controls 106 (e.g., a switch and/or speed control) for controlling operation of the surface cleaning head 100. In other embodiments, a surface cleaning head 100 may be provided without a wand and handle (e.g., in a robotic vacuum surface cleaning head or in a motorized attachment surface cleaning head).

The surface cleaning head 100 includes a cleaning head housing 110, an agitator chamber 120 located in the housing 110, and a rotatable agitator 130 located in the agitator chamber 120. The rotatable agitator 130 rotates about a rotation axis 2 (FIGS. 1A and 3) that may be generally orthogonal to the direction of travel 4 of the surface cleaning head 100. In the illustrated embodiment, the agitator chamber 120 is openable to provide access to the agitator 130. Providing access to the agitator 130 within the agitator chamber 120 may allow a user to inspect and/or clean the agitator 130 without having to remove the agitator and without having to touch a dirty agitator. The rotatable agitator 130 may also be removable from the agitator chamber 120 for inspection, cleaning and/or replacement. In other embodiments, the openable agitator chamber 120 may include a fixed agitator that is not removable, a non-rotatable or non-driven agitator or any type of cleaning member.

The cleaning head housing 110 may generally include one or more pieces that enclose or encompass components of the surface cleaning head 100. In the illustrated embodiment, the surface cleaning head 100 is used in an "all in the head" type vacuum cleaner. As such, the cleaning head housing 110 encloses or encompasses an air transportation and treatment system 140 (shown schematically in FIGS. 1 and 3). The air transportation and treatment system 140 includes, for example, a suction motor 142, a cyclone including a cyclone chamber 144 and a dirt collection chamber 146 external to the cyclone chamber 144, and one or more filters 148. An air flow path 141 extends from a dirty air inlet 143 located in the agitator chamber 120 to a clean air outlet 145. The suction motor 142 causes air to be drawn into the dirty air inlet 143, through the cyclone chamber 144, and out the clean air outlet 145. As the dirt passes through the cyclone chamber 144, dirt is collected in the dirt collection chamber 146. Smaller particles may also be collected in the filter(s) 148. The air transportation and treatment system 140 may be similar to those used in existing or known "all in the head" type vacuum cleaners, for example, as disclosed in U.S. Pat. No. 7,329,294, which is incorporated herein by reference.

The cleaning head housing 110 includes a front end portion 112, a rear end portion 114, laterally disposed sides 113, 115, an upper portion 116, and a bottom portion 118. In the illustrated embodiment, the wand 102 is steeringly coupled to the rear end portion 114, and the agitator chamber 120 is located in the front end portion 112 and extends between a top opening 117 in the upper portion 116 and a bottom opening 119 in the bottom portion 118. The rotatable agitator 130 is located in the agitator chamber 120 and is configured to contact a surface to be cleaned through the bottom opening 119. The top opening 117 and the bottom opening 119 allow the rotatable agitator 130 to be accessed from either the top or bottom or the top and bottom simultaneously, which may help facilitate inspection or servicing of the agitator. For example, a user may clean the agitator 130 via the top opening 117 while allowing debris separated from the agitator 130 to fall out of the chamber via the bottom opening 119. The rotatable agitator 130 may also be removable from the agitator chamber 120, for example, through the top opening 117, as will be described in greater detail below.

Figure 3:
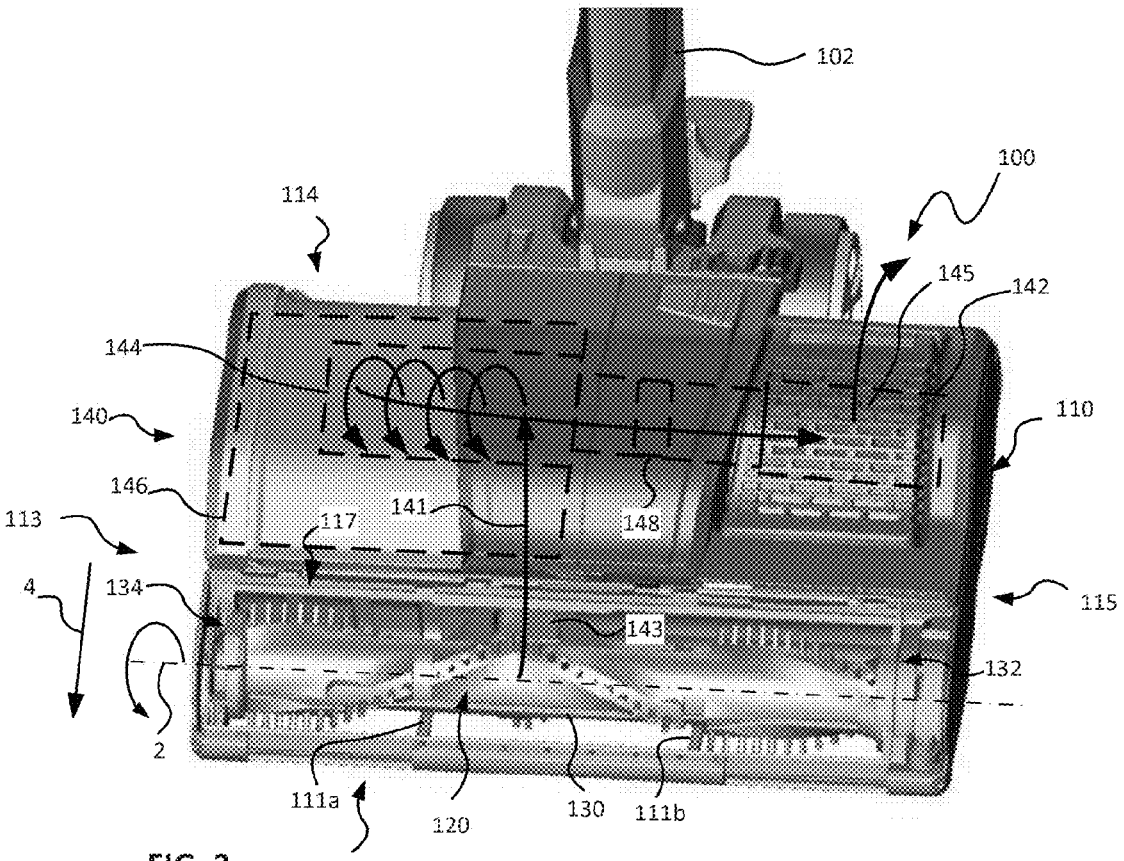
FIG. 3 is a perspective view of the surface cleaning head shown in FIG. 1 with an external cover removed to show a top opening into the agitator chamber.
Figure 3A:
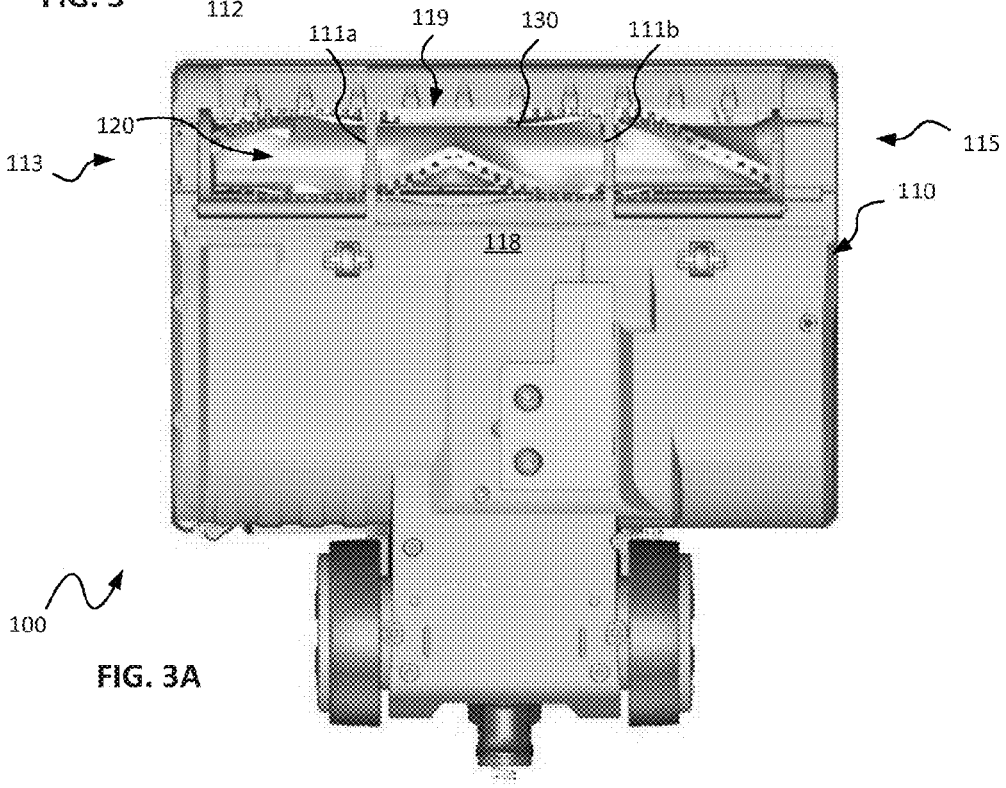
FIG. 3A is a bottom view of the surface cleaning head shown in FIG. 1 showing a bottom opening into the agitator chamber.

In the illustrated embodiment, the top opening 117 of the agitator chamber 120 has a width that is greater than a width of the agitator 130 to help provide access to the entire agitator 130 and/or to allow the rotatable agitator 130 to be removed. In other embodiments, the width of the top opening 117 of the agitator chamber 120 may be shorter. The bottom portion 118 includes one or more bottom guards or bars 111*a*, 111*b* extending across the bottom opening 119 (FIG. 3A).

In the illustrated embodiment, an external cover 122 is mounted to the upper portion 116 of the cleaning head housing 110 for covering the top opening 117 of the agitator chamber 120 (FIG. 1). The agitator chamber 120 may thus be opened while the surface cleaning head 100 is resting on the floor, thereby eliminating the need to pick up or reposition the surface cleaning head in order to access the agitator chamber 120. The external cover 122 is movable between a closed position (e.g., FIG. 1) and an open position (e.g., FIG. 3). In the closed position, the external cover 122 forms the top portion of the agitator chamber 120. The agitator chamber 120 and the agitator 130 may thus be easily accessed (e.g., without having to remove other walls or covers) simply by moving the external cover 122 to the open position. In the illustrated embodiment, the external cover 122 extends substantially the entire width of the surface cleaning head 100 but may also be shorter in other embodiments.

In the illustrated embodiment, the surface cleaning head 100 includes one or more transparent regions 124 that allow visual inspection of the agitator chamber 120. The transparent region 124 may be made out of a polycarbonate material. In this embodiment, the transparent region 124 is in the form of a window located on the external cover 122. Additionally or alternatively, one or more transparent regions may be located in other locations on the cleaning head housing 110 that allow visual inspection of the agitator 130 in the agitator chamber 120, for example, on the sides 113, 115. The transparent region 124 together with the movable external cover 122 thus facilitate a determination of debris in the agitator chamber 120 and/or agitator 130 and then removal of that debris.

The external cover 122 may be locked in the closed position using any suitable mechanism. In the illustrated embodiment, the external cover 122 includes one or more latch releases 126*a*, 126*b* for releasing respective latching mechanisms (not shown) that hold the external cover 122 into engagement with the cleaning head housing 110, as will be described in greater detail below. In the illustrated embodiment, the latch releases 126*a*, 126*b* are located proximate the respective sides 113, 115. Additionally or alternatively, one or more releasable latches may be provided in other locations on the external cover 122 and/or on the cleaning head housing 110. The external cover 122 may be pivotably or movably coupled to the cleaning head housing 110, as will be described in greater detail below, or may be completely removable from the cleaning head housing 110 (FIG. 3).

The surface cleaning head 100 may also include one or more lights, such as LEDs 129 on the external cover 122. In this embodiment, wiring (not shown) extends from the housing 110 to the external cover 122 and passes through the inside of the cover 122 to the LEDs 129. The lights may also be mounted on other locations on the cleaning head housing 110.

Figure 1A:
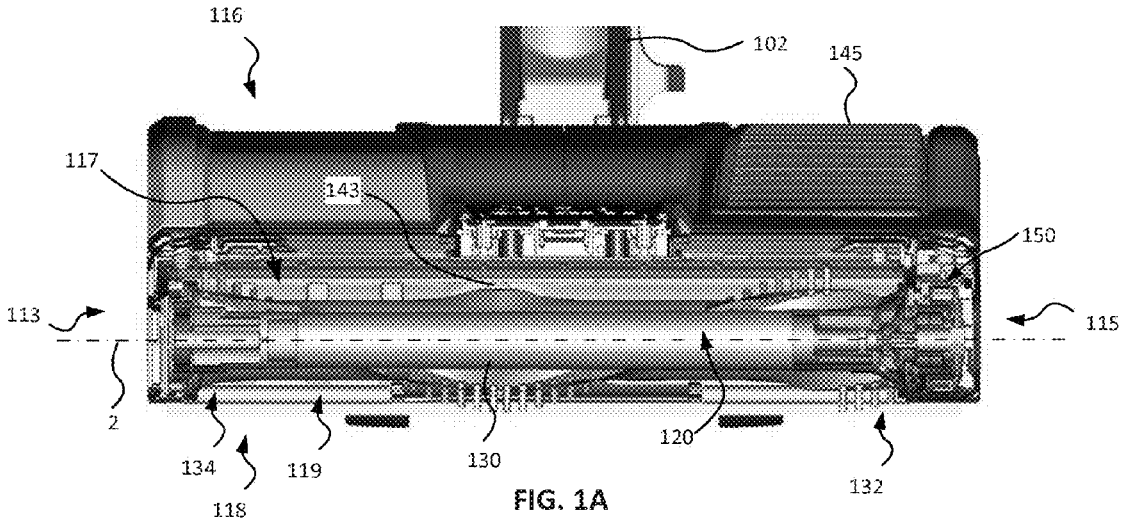
FIG. 1A is a cross-sectional view of the surface cleaning head shown in FIG. 1 taken along line 1A-1A.

In the illustrated embodiment, as shown in FIG. 1A, the rotatable agitator 130 is engaged with an agitator drive mechanism 150 at a driven end 132 and rotates freely at a non-driven end 134 of the rotatable agitator 130. The agitator drive mechanism 150 thus drives the driven end 132 to cause the rotatable agitator 130 to rotate around the rotation axis 2 during use. The drive mechanism 150 may axially engage the driven end 132 of the rotatable agitator 130 without engaging the rotatable agitator 130 with a belt and in a manner that allows the agitator 130 to be easily removed and inserted, as will be described in greater detail below.

Figure 2:
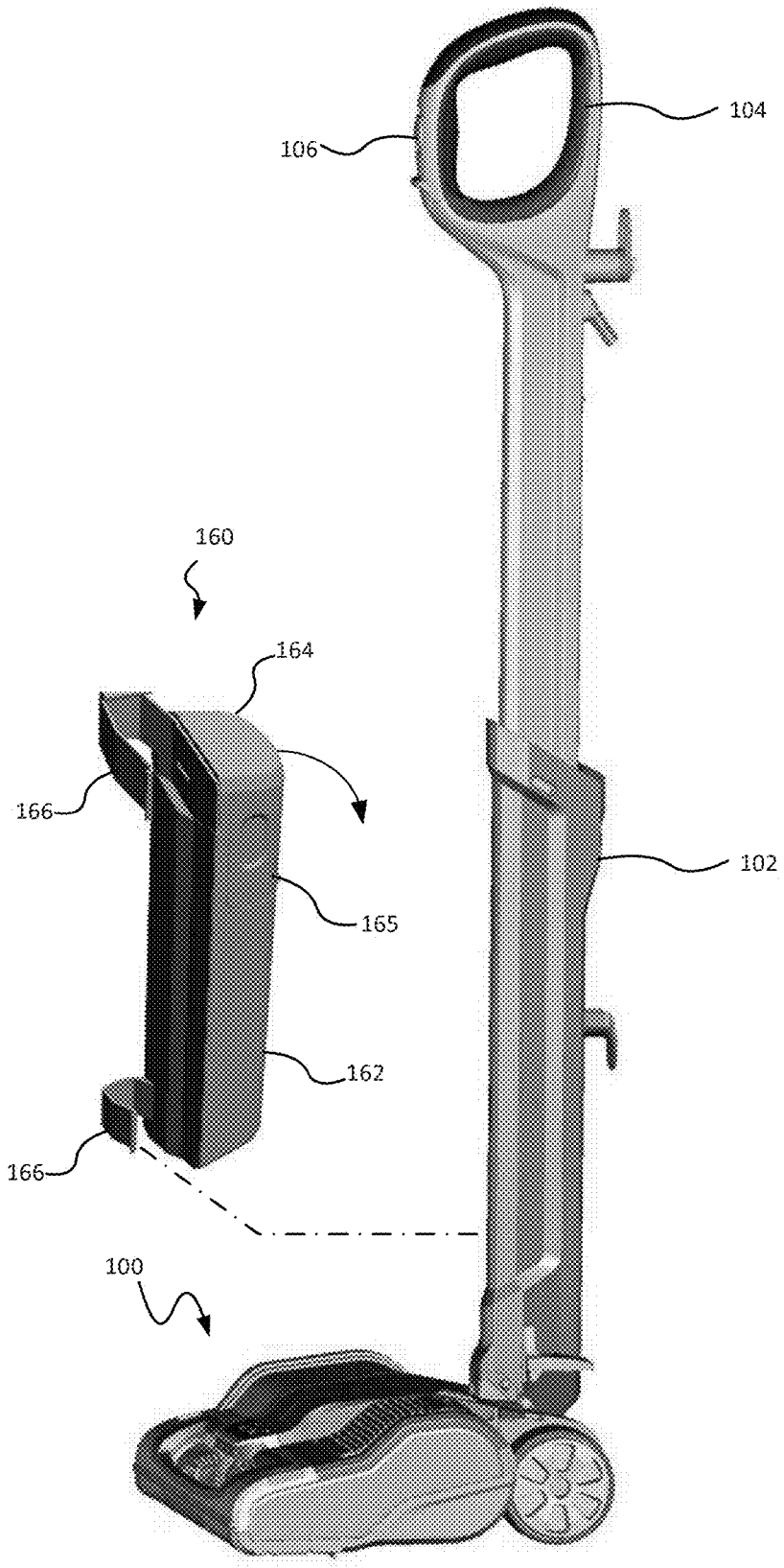
FIG. 2 is a perspective view of a vacuum cleaner with the surface cleaning head shown in FIG. 1 connected to a wand and handle.

As shown in FIG. 2, an agitator caddy 160 may be mounted on the wand 102 for holding one or more spare agitators, such as a rotatable driven agitator or a non-driven agitator. The agitator caddy 160 may be removably mounted or fixed to the wand 102. In other embodiments, the agitator caddy 160 may be mounted in other locations on the surface cleaning head 100 or wand 102. The illustrated embodiment of the agitator caddy 160 includes a container 162 sized and configured to receive at least one agitator and a cover 164 pivotably coupled to the container 162 at a hinge 165. In other embodiments, the agitator caddy 160 may include a container without a cover or may include other structures configured to receive and hold an agitator.

The illustrated embodiment of the agitator caddy 160 further includes one or more mounting arms 166 extending from container 162. The mounting arms engage the wand 102 to mount the caddy 160 to the wand 102. The mounting arms 166 may be shaped similar to the contours of the wand 102 and may be dimensioned such that the arms 166 flex and apply pressure against the wand 102 to hold the agitator caddy 160 in place and prevent the caddy 160 from sliding. In other embodiments, the agitator caddy 160 may include other structures for engaging and mounting on the wand 102 and/or surface cleaning head 100.

Figure 4A:
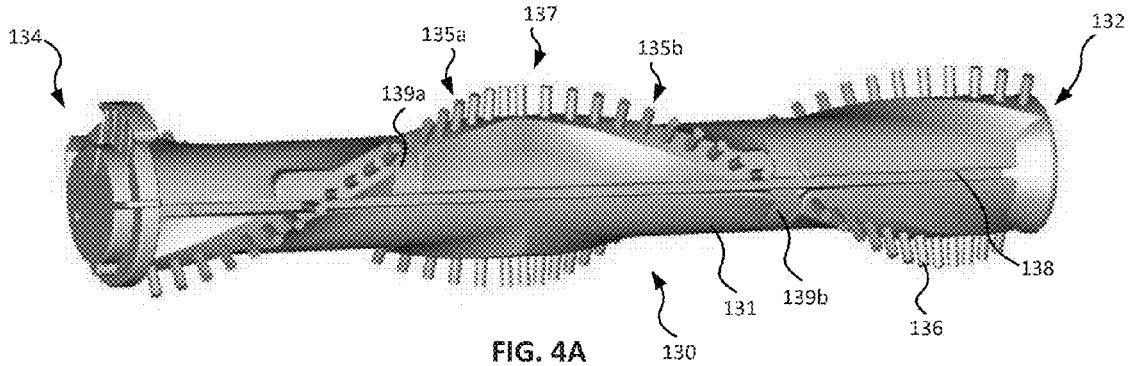
FIGS. 4A and 4B are different perspective views of an embodiment of a brush roll agitator for use in the surface cleaning head shown in FIG. 1.
Figure 4B:
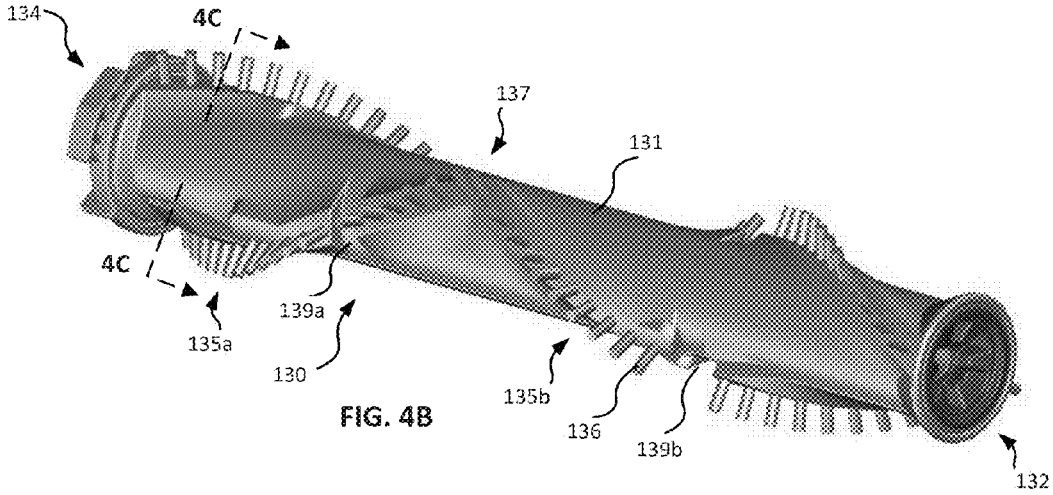
Figure 4C:
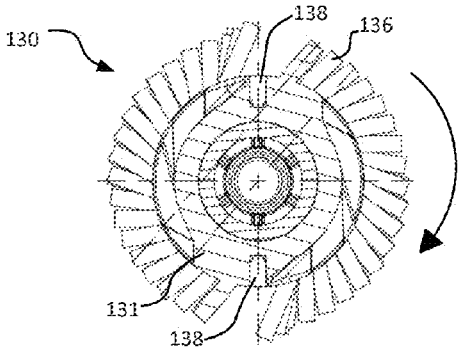
FIG. 4C is a cross-sectional view of the brush roll agitator shown in FIG. 4B taken along line 4C-4C.

In this embodiment, as shown in greater detail in FIGS. 4A-4C, the rotatable agitator 130 is a rotatable brush roll including brush agitator elements 136. The brush agitator elements 136 may include brush bristles, such as nylon bristles, extending substantially radially from an agitator body 131. In this embodiment, the brush agitator elements 136 are arranged in one or more helical patterns 135*a*, 135*b* around the agitator body 131. The helical patterns 135*a*, 135*b* include, for example, opposite helical patterns 135*a*, 135*b* that meet at a location 137 on the agitator body 131, forming a chevron shaped pattern. The location 137 where the helical patterns of agitator elements 136 meet (i.e., the point of the chevron) may correspond to the location of the dirty air inlet 143 in the agitator chamber 120 when the agitator is inserted in the chamber. As shown in FIG. 4C, the agitator elements 136 may be angled relative to radial lines extending radially from an axis of rotation of the agitator 130. In the illustrated embodiment, the agitator elements 136 are angled toward a direction of rotation.

This embodiment of the rotatable agitator 130 also includes one or more cutting grooves 138 extending substantially axially along at least a portion of the agitator body 131. The cutting groove(s) 138 are recessed below a surface of the agitator body 131 and have a depth sufficient to accommodate a cutting tool (e.g., scissors or knife). The cutting tool may thus be inserted beneath strands of hair, string or other types of debris that can get wound around the rotatable agitator 130 during use. The cutting tool may then be translated along the length of the cutting groove 138 to cut hair or other debris entangled around the agitator 130. The rotatable agitator 130 may be manually rotated to allow the cutting groove 138 to be accessed through the top opening 117 or through the bottom opening 119 of the chamber 120. If the rotatable agitator 130 is removable, the agitator 130 may be removed for cutting away the hair and other entangled debris. This embodiment of the rotatable agitator 130 further includes spaces 139*a*, 139*b* to accommodate the bottom guards or bars 111*a*, 111*b* such that the rotatable agitator 130 extends partially through the bottom opening 119 (see FIG. 1A).

The agitator body 131 may be solid, hollow or partially solid/hollow. The agitator body 131 may also include wheel weights to balance the rotatable agitator 130 when driven. One example of the wheel weights (not shown) may include screws threaded into the body 131. A hollow agitator body may not need to be weighted.

A rotatable agitator or brush roll may also include other types of agitator patterns and/or agitator elements including, without limitation, fabric material (e.g., cloth, felt or polyester), a rubber material, and bristles of different thicknesses and/or materials. Rotatable agitators with different agitator patterns and/or agitator elements may be used for different surfaces, functions and/or applications. A rotatable agitator with stiffer bristles may be used, for example, for carpets and/or deep cleaning. A rotatable agitator with softer bristles or fabric may be used, for example, for hardwood floors and/or delicate quick cleaning. Thus, different brush rolls having different agitating characteristics may be easily interchangeable in a surface cleaning head with an openable agitator chamber, consistent with embodiments described herein, to increase the functionality and improve the performance of the vacuum cleaner.

Figure 5A:
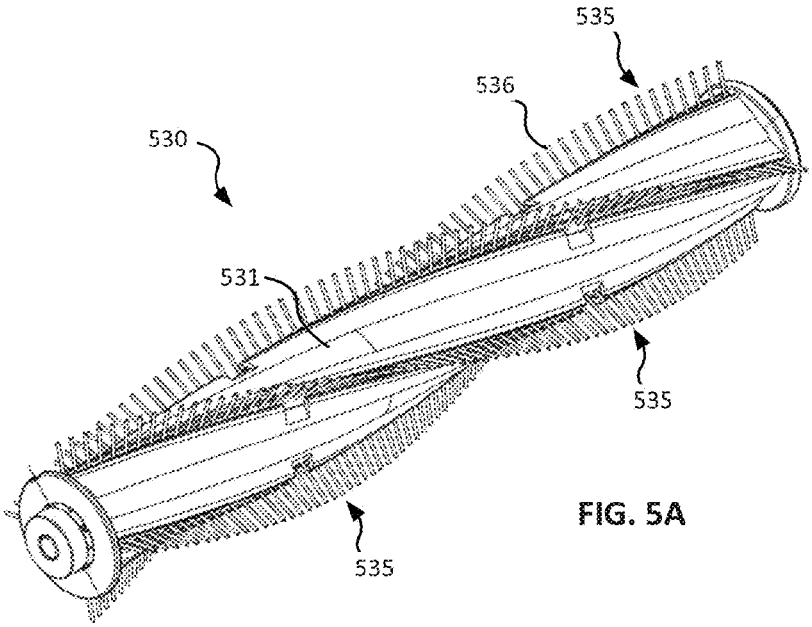
FIGS. 5A and 5B are perspective and side views, respectively, of another embodiment of a brush roll agitator for use in the surface cleaning head shown in FIG. 1.
Figure 5B:
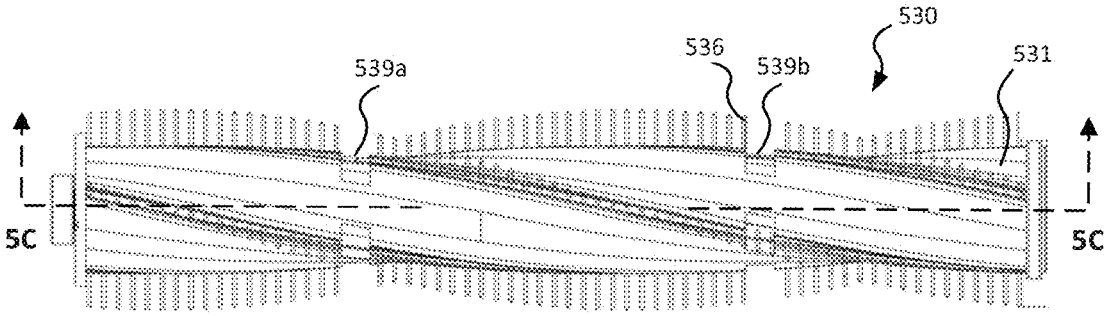
Figure 5C:
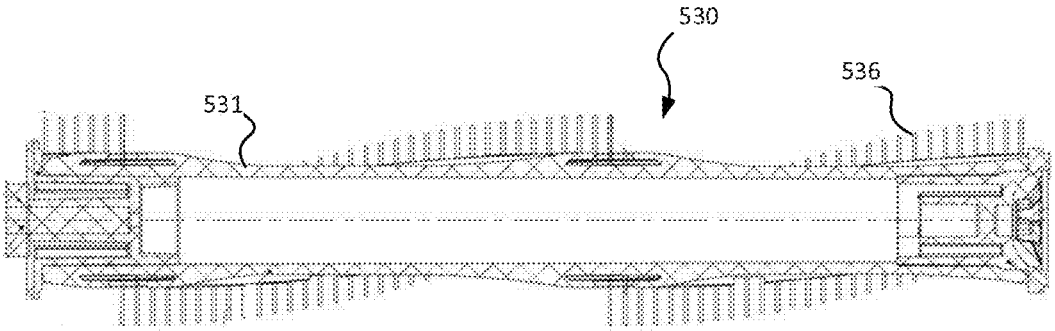
FIG. 5C is a cross-sectional view of the brush roll agitator shown in FIG. 5B taken along line 5C-5C.

As shown in FIGS. 5A-5C, another embodiment of a rotatable agitator 530 includes agitator elements 536 arranged in helical patterns 535 extending from one end to the other end of the agitator body 531. In this embodiment, the agitator elements 536 include bristles extending in a substantially continuous row with two breaks or spaces 539*a*, 539*b* to accommodate the bottom guards or bars 111*a*, 111*b* such that the rotatable agitator 530 extends partially through the bottom opening 119 when positioned in the agitator chamber 120 shown in FIG. 1A.

In this embodiment, the agitator elements 536 may also be different, for example, bristles of a different material, thickness and/or height as compared to the agitator elements 136 in the agitator 130. In one example, the agitator 130 shown in FIGS. 4A-4C may include stiffer nylon bristles for carpet surfaces or deep cleaning applications and the agitator 530 shown in FIGS. 5A-5C may include softer nylon bristles for hard surfaces or delicate applications. The stiffer nylon bristles of the brush roll agitator 130 for the carpet may be thicker (e.g., a diameter of 0.23±0.02 mm) and shorter (e.g., a height from the brush roll agitator body 131 of 8.0±0.6 mm). The softer nylon bristles of the brush roll agitator 530 for the hard surfaces may be thinner (e.g., a diameter of 0.04±0.02 mm) and longer (e.g., a height from the brush roll agitator body 531 of 13±0.2 mm). When the brush roll agitator 530 has longer bristles, the diameter of the brush roll agitator body 531 may be smaller such that the overall outer diameter can fit in the agitator chamber. In the example embodiment, the brush roll agitator 130 with the thicker and shorter bristles has an overall outer diameter of about 54±0.3 mm and the brush roll agitator 530 with the thinner and longer bristles has an overall outer diameter of about 55±0.4 mm.

According to a further embodiment, a rotatable agitator (not shown) may include fabric material wrapped around at least a portion of an agitator body. The fabric material may include, for example, a felt material. This embodiment of the rotatable agitator may also be suited for hard surfaces and/or delicate applications. A rotatable agitator may include any combination of agitator elements such as, for example, a soft agitator element (e.g., a fabric material or soft bristles/brush) and a relatively stiff agitator element (e.g., a rubber blade or stiff bristles/brush).

In further embodiments, a surface cleaning head 100 with an openable agitator chamber 120 may be configured to receive non-rotatable, non-driven agitators in addition to rotatable driven agitators. A non-driven agitator is configured to engage each side of the agitator chamber 120 without engaging the drive mechanism 150 on the driven side of the chamber, as will be described in greater detail below. The non-driven agitator is also configured to engage the dirty air inlet 143 to allow air flow through the non-driven agitator into the air transportation and treatment system 140. A non-driven agitator may be suited for flat, hard surfaces such as hardwood floors or other surfaces or conditions where a rotating agitator may be undesirable.

One embodiment of a non-driven agitator 630 is shown in greater detail in FIGS. 6A-6D. In this embodiment, the non-driven agitator 630 includes an agitator body 631 including a bottom portion with a pad support member 633 that supports one or more cleaning pads 635*a*-635*c*. The agitator body 631 may be a single molded piece or may be assembled from two or more molded pieces that are attached together, such as by screws or other attachment methods. As shown, the cleaning pad(s) 635*a*-635*c* generally extend the length of the non-driven agitator 630 with breaks or spaces 639*a*, 639*b* to accommodate the bottom guards or bars across the bottom opening of the agitator chamber in the surface cleaning head. Although the illustrated embodiment shows three cleaning pads 635*a*-635*c*, other numbers of cleaning pads may be used.

The cleaning pads 635*a*-635*c* may include textile or fabric pads, such as felt pads, or other sheets or pads having a nap or pile suitable for cleaning a surface. The cleaning pads 635*a*-635*c* may also include brush pads having bristles extending therefrom. Similar to the brush rolls described above, different non-driven agitators may have different types of cleaning pads for different cleaning applications, such as brush pads with stiff bristles and brush pads with soft bristles. In one example, a brush pad with soft bristles may have thinner nylon bristles (e.g., a diameter of 0.04±0.02 mm).

The cleaning pad(s) 635*a*-635*c* may also be removably attached to the bottom support member 633, for example, using hook and loop fasteners such as VELCRO® or other attachment methods. Other attachment mechanisms may be used such as clips. Thus, different cleaning pads with different textures may be attached to the non-driven agitator 630 for use in different applications. Removable cleaning sheets or pads may also be attached to other locations of the agitator body 631, for example, the sheets or pads may be wrapped around the pad support member 633 and attached on a top portion of the agitator body 631. Combinations of different types of cleaning pads may also be used at the same time or different times to provide different cleaning characteristics. The cleaning pads may also be reusable or disposable. In other embodiments, the non-driven agitator 630 may include permanent cleaning or abrasive material attached thereto to provide cleaning or scrubbing in addition to or instead of the removable cleaning sheets or pads.

In this embodiment of the non-driven agitator 630, the agitator body 631 also defines one or more air inlets 636*a*, 636*b*, an air outlet 638 and an air path therebetween such that the inlet(s) 636*a*, 636*b* are in fluid communication with the outlet 638. The air inlets 636*a*, 636*b* are elongated and extend along at least a portion of the pad support member 633 adjacent to the cleaning pad(s) 635*a*-635*c*. Although the illustrated embodiment shows the cleaning pad(s) 635*a*-635*c* on one side of the air inlets 636*a*, 636*b*, cleaning pads 635*a*-635*c* may be located on both sides of the air inlets 636*a*, 636*b*. The air is directed from the air inlets 636*a*, 636*b* along the air path (as indicated by the arrows) to the air outlet 638. When the non-driven agitator 630 is positioned in the agitator chamber 120 (FIG. 3), the air outlet 638 is engaged in fluid communication with the dirty air inlet 143 and the air inlets 636*a*, 636*b* are located at the bottom opening of the agitator chamber 120 such that the air transportation and treatment system 140 causes the air to be drawn through the air inlets 636*a*, 636*b* and the air outlet 638. The non-driven agitator 630 thus facilitates air flow through the surface cleaning head while also providing a non-rotating cleaning pad.

The air outlet 638 may include a seal 639 around a perimeter thereof to provide sealing between the air outlet 638 and the dirty air inlet. The seal 639 may be made of an elastomeric material or other suitable sealing material and may have any known configuration, such as a lip seal or a face seal, capable of forming a seal against a flat face. Alternatively, the air outlet 638 may be configured to engage a seal around the dirty air inlet in the agitator chamber.

Figure 6A:
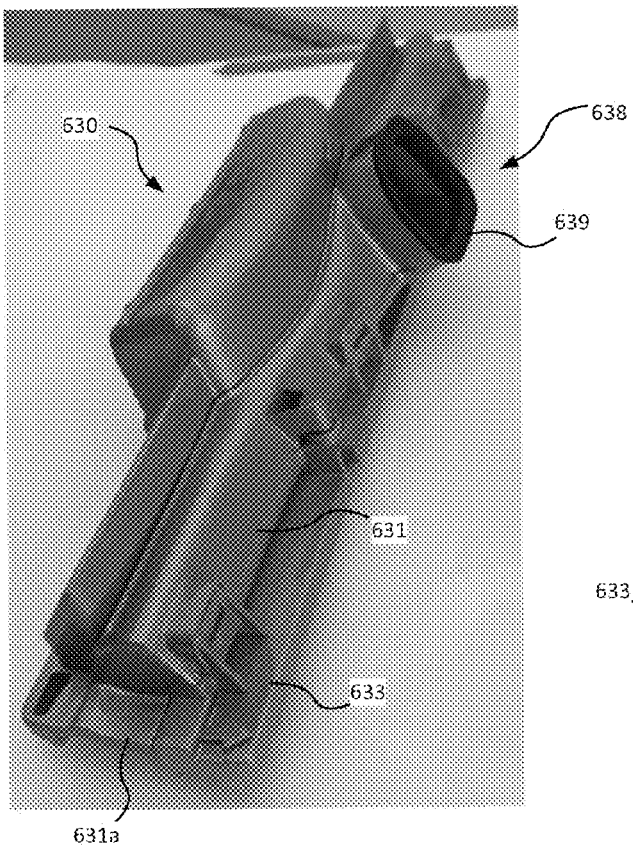
FIG. 6A is a perspective view of an embodiment of a non-driven agitator for use in a surface cleaning head, consistent with embodiments of the present disclosure.
Figure 6B:
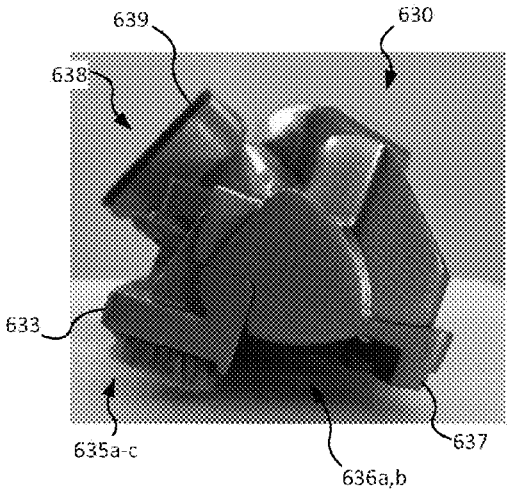
FIG. 6B is an end view of the non-driven agitator shown in FIG. 6A.
Figure 6C:
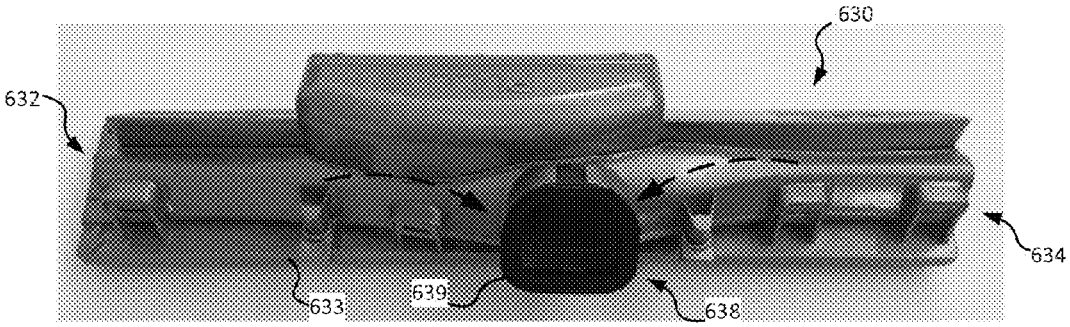
FIG. 6C is a top view of the non-driven agitator shown in FIG. 6A.
Figure 6D:
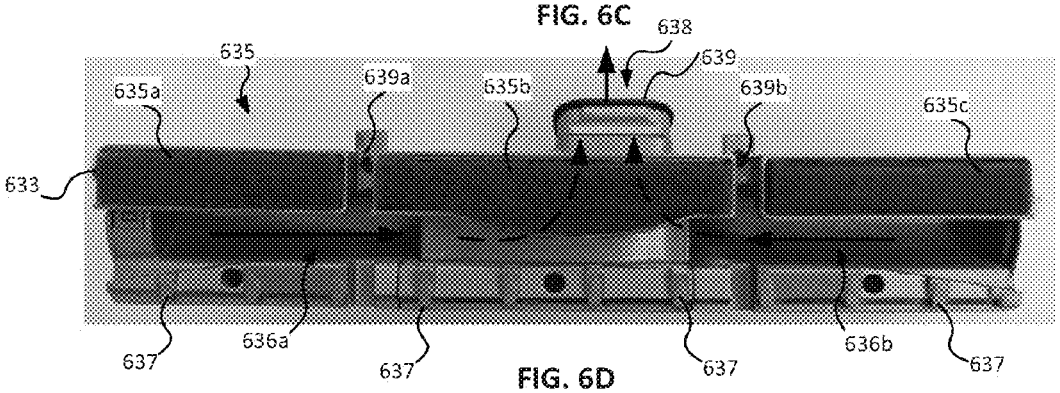
FIG. 6D is bottom view of the non-driven agitator shown in FIG. 6A.

The illustrated embodiment of the non-driven agitator 630 also includes one or more projections 637 on the bottom portion of the agitator body 631. The projections 637 are configured to be received in associated slots in the agitator chamber, as will be described in greater detail below. These projections 637 are generally spaced along the bottom portion of the body 631 on the other side of the air inlets 636*a*, 636*b*. The non-driven agitator 630 may also include at least one wing 631*a* extending from at least one end of the agitator body 631 (FIG. 6A). The wing 631*a* is configured to be positioned beneath a drive member in the agitator chamber, as will be described in greater detail below.

Figure 7A:
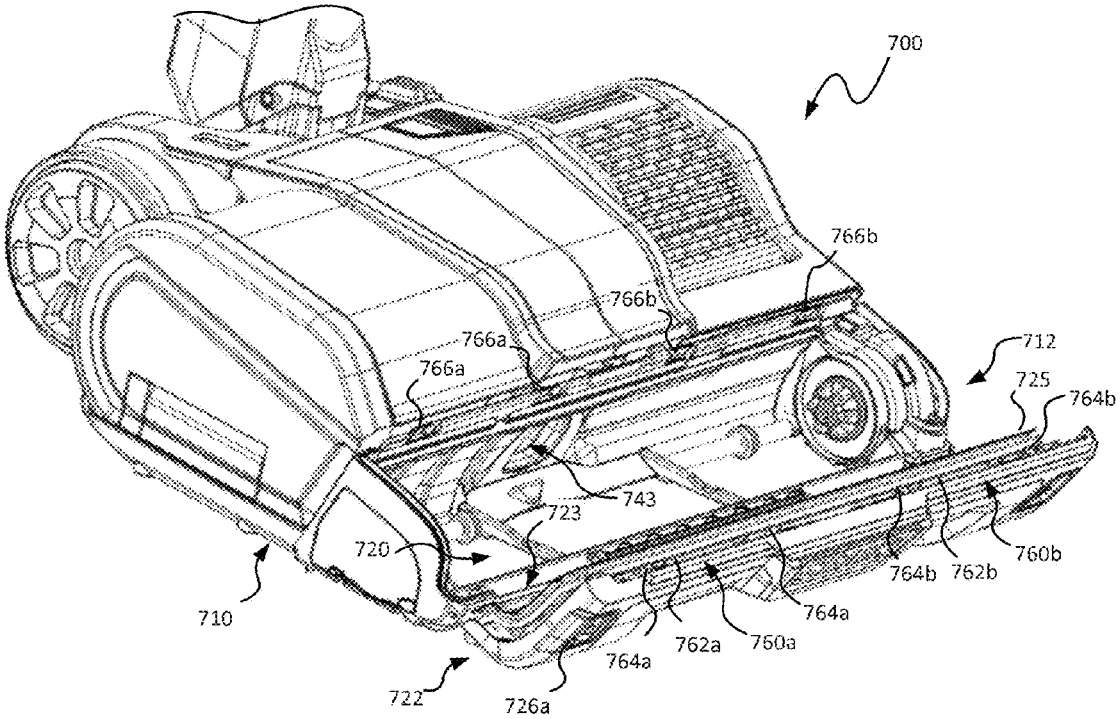
FIGS. 7A and 7B are different side perspective views of a surface cleaning head with an external cover in an open position and with an agitator removed from the agitator chamber, consistent with an embodiment of the present disclosure.
Figure 7B:
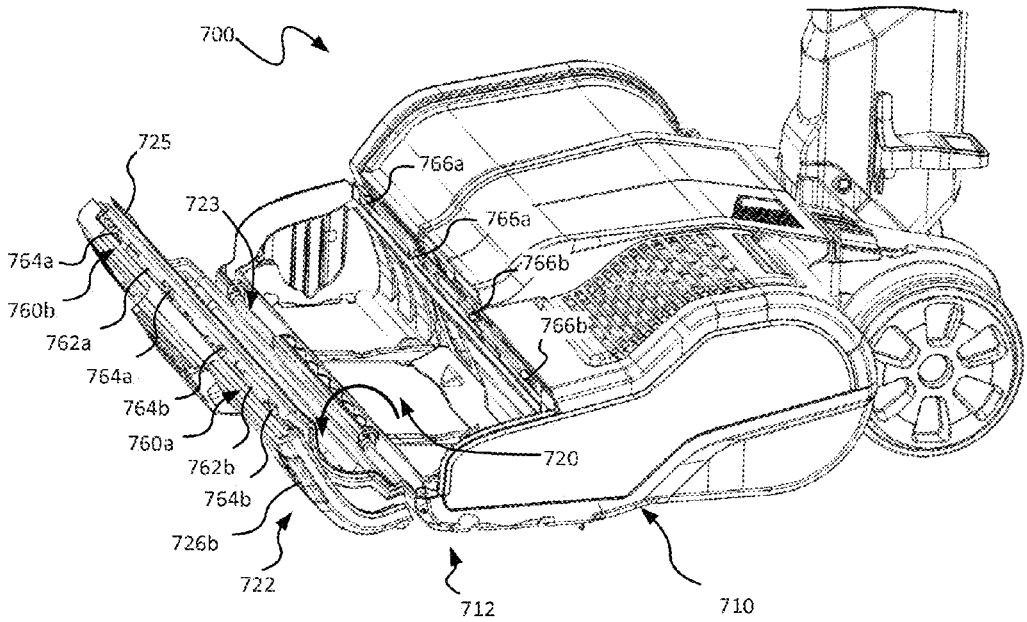
Figure 8:
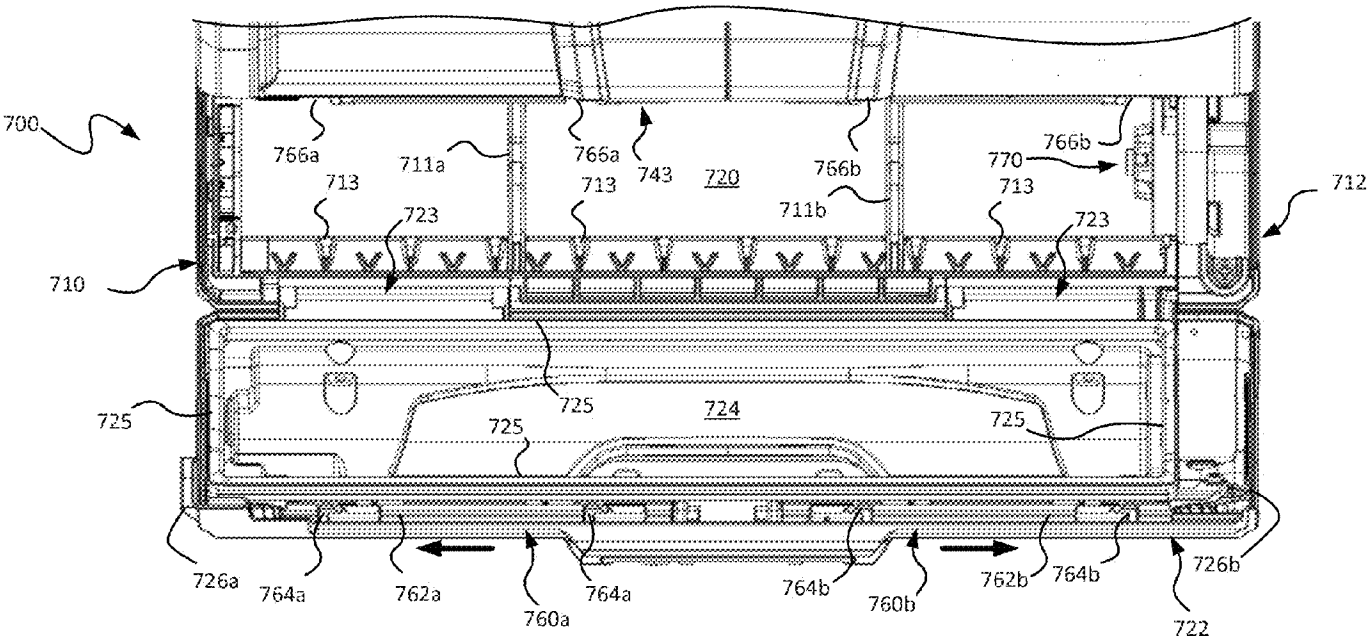
FIG. 8 is a top view of agitator chamber and external cover of the surface cleaning head shown in FIGS. 7A and 7B.
Figure 9:
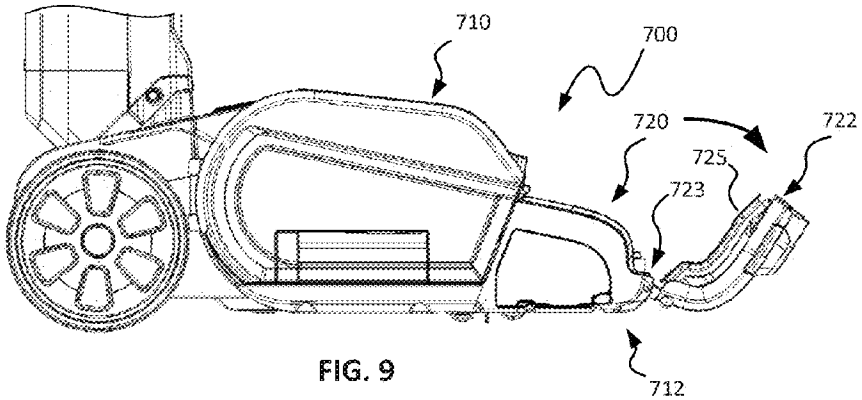
FIG. 9 is a side view of the surface cleaning head shown in FIGS. 7A and 7B.

Referring to FIGS. 7-9, an embodiment of a surface cleaning head 700 with a pivotable external cover 722 is described in greater detail. In this embodiment, the surface cleaning head 700 includes a cleaning head housing 710 including an agitator chamber 720 and the pivotable external cover 722 coupled with a hinge 723 to a front portion 712 of the cleaning head housing 710. The pivotable external cover 722 pivots at the hinge 723 between a closed position (not shown) and an open position (shown). If the pivotable external cover 722 includes lights, the wiring (not shown) for the lights may pass across the hinge 723. In this embodiment, the pivotable external cover 722 pivots forwardly relative to the housing 710 to open the agitator chamber 720 (FIG. 9). In the open position, the agitator chamber 720 is accessible and the agitator may be removed from the agitator chamber 720 as shown. This embodiment of the surface cleaning head 700 may also be used with a rotatable agitator that is not removable such that the pivotable external cover 722 is opened merely to remove the debris that has collected on the rotatable agitator. The pivotable external cover 722 may also include a transparent window 724 extending across a central region of (FIG. 8) for viewing the agitator chamber 720 when the cover is in the closed position.

A sealing member 725 may also be located between the pivotable external cover 722 and the cleaning head housing 710 and around the perimeter of the agitator chamber 720. A removable agitator (not shown) may thus be mounted in the agitator chamber 720 inside of the sealing member 725. In the illustrated embodiment, the pivotable external cover 722 includes the sealing member 725 extending around an inside perimeter of the cover 722. In the closed position, the sealing member 725 seals against the cleaning head housing 710 around the perimeter of the agitator chamber 720. The sealing member 725 is capable of forming a substantially air tight seal at the interface between the cover 722 and the cleaning head housing 710 with substantially equal pressure around the perimeter of the chamber 720 to prevent air and/or debris from passing through.

The sealing member 725 may be made of an elastomeric material or other suitable sealing material and may have any known configuration capable of forming a seal against a flat face or rib. A lip seal or face seal, for example, may be used on the pivotable external cover 722 to facilitate alignment and sealing when the cover pivots to the closed position. In other embodiments, the sealing member 725 may be provided on the cleaning head housing 710.

The surface cleaning head 700 may also include a latch mechanism to secure the pivotable external cover 720 in the closed position. The latch mechanism may provide multiple points of engagement around the perimeter between the external cover 720 and the cleaning head housing 710 such that the sealing member 725 is engaged with substantially equal pressure around the perimeter of the chamber 720.

In the illustrated embodiment, the pivotable external cover 722 includes latch mechanisms 770*a*, 770*b* on an opposite side from the hinge 723. The latch mechanisms 770*a*, 770*b* may include slidable actuators 772*a*, 772*b* with hooks 774*a*, 774*b* that releasably engage slots 776*a*, 776*b* on the cleaning head housing 710. Each of the latch mechanisms 770*a*, 770*b* include two hooks 774*a*, 774*b* to provide four spaced apart points of engagement between the cover 720 and the housing 710.

The slidable actuators 772*a*, 772*b* translate in a transverse direction between a latched position and an unlatched position. The slidable actuators 772*a*, 772*b* may be biased into the latched position, for example, by springs (not shown). The slidable actuators 772*a*, 772*b* are operably coupled to latch releases 726*a*, 726*b* for moving the slidable actuators 772*a*, 772*b* against the spring bias, thereby releasing the hooks 774*a*, 774*b* from the slots 776*a*, 776*b* (as indicated by the arrows in FIG. 8). In other embodiments, the latch mechanisms 770*a*, 770*b* may be located on the cleaning head housing 110 and the slots 776*a*, 776*b* may be located on the external cover 722. Although two latch mechanisms and four hooks are shown, other numbers of latch mechanisms and hooks may also be used.

A movable external cover may also have other configurations. For example, a surface cleaning head may have a pivotable external cover that pivots rearwardly relative to the cleaning head housing to the open position. A surface cleaning head may also have a multiple-piece pivotable external cover including one cover portion that pivots forwardly and another cover portion that pivots rearwardly relative to the cleaning head housing. Another embodiment of a surface cleaning head may have a slidable external cover that slides or rolls in a longitudinal direction relative to the cleaning head housing, for example, similar to a garage door. A further embodiment of a surface cleaning head may have a slidable external cover that slides laterally relative to the cleaning head housing.

In any of these embodiments, the external cover may be latched, for example, using a latching mechanism as described above or any other latching mechanism. In any of these embodiments, the external cover may be sealed, for example, using a sealing member as described above or any other sealing member. In each of these embodiments, the external cover may be moved between open and closed positions while remaining engaged with the surface cleaning head housing. In other embodiments, the external cover may be completely removed from the surface cleaning head housing. Other variations and locations for the external cover are also within the scope of the present disclosure.

Figure 10:
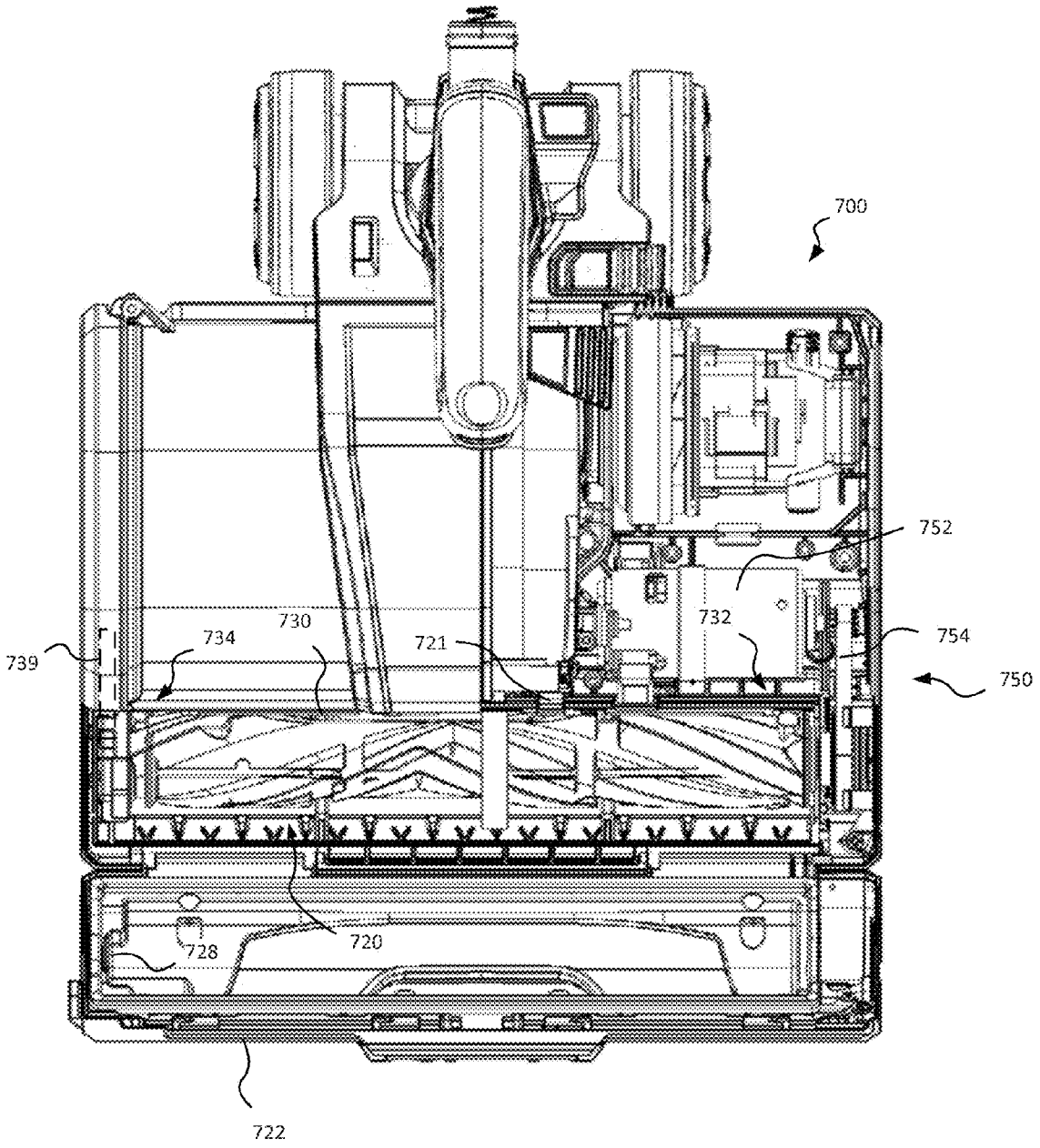
FIG. 10 is a top view of the surface cleaning head shown in FIGS. 7A and 7B including a rotatable agitator and a drive mechanism, consistent with an embodiment of the present disclosure.

Referring to FIG. 10, this embodiment of the surface cleaning head 700 may receive a removable rotatable agitator 730 that is driven by a drive mechanism 750. In this embodiment, the drive mechanism 750 axially engages a driven end 732 of the rotatable agitator 730 at a driven side of an agitator chamber 720 and a non-driven end 734 of the rotatable agitator 730 is mounted to rotate freely at a non-driven side of the agitator chamber 720. Both the driven end 732 and the non-driven end 734 of the removable rotatable agitator 730 are mounted in the agitator chamber 720 in a manner that allows the agitator 730 to be removed when the external cover 722 is in an open position.

In this embodiment, the external cover 722 is configured to secure the removable rotatable agitator 730 in the agitator chamber 720. The external cover 722 includes, for example, an engaging structure 728 that engages the non-driven end 734 of the removable rotatable agitator 730. In other embodiments, an agitator engaging member 739 may be movably mounted to the surface cleaning head housing 710 for movement into engagement with the non-driven end 734 of the removable rotatable agitator 730. The agitator engaging member 739 is shown schematically but may be in the form of a clip, slide or latch and may slide and/or pivot in to and out of engagement with the agitator 130.

Although this embodiment shows a pivotable external cover 722 similar to that shown and described above, the removable rotatable agitator 730 in this embodiment may also be used with other types of openable external covers.

The surface cleaning head 700 may also include a kill switch that stops power to the drive mechanism 750 when the pivotable external cover 722 is in the open position. A kill switch actuator 721 is located at a point along the perimeter of the agitator chamber 720 to activate the kill switch when the pivotable external cover 722 is opened. In the example embodiment, the kill switch actuator 721 is biased to an open position that opens the kill switch. When the pivotable external cover 722 is in the closed position, the cover 722 engages the kill switch actuator 721 to close the kill switch, allowing power to the drive mechanism 750. When the pivotable external cover 722 moves to the open position, the actuator 721 moves to the biased open position to open the kill switch, stopping power to the drive mechanism 750. In one embodiment, the kill switch actuator 721 may be recessed to prevent being actuated by a user and may be actuated by a protrusion (e.g., a small rod) extending from the cover 722. The actuator 721 may also be in other locations and may be actuated in other ways.

Figure 11:
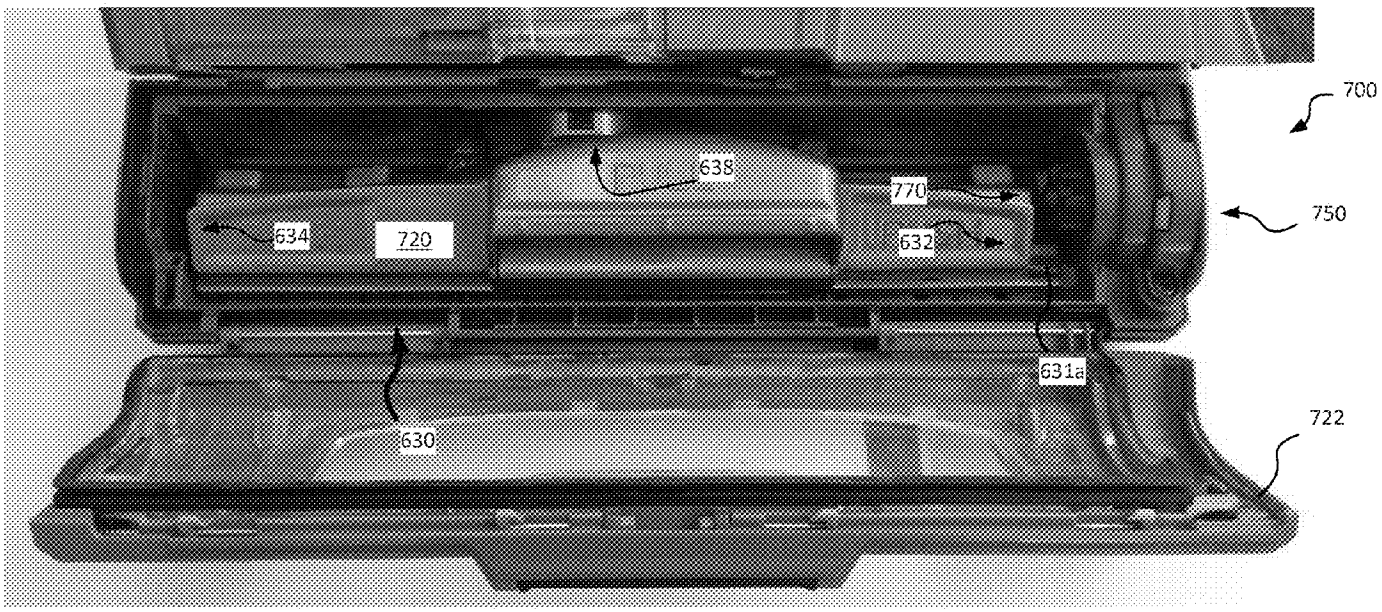
FIG. 11 is a top view of the surface cleaning head including a non-driven agitator received in the agitator chamber, consistent with another embodiment of the present disclosure.
Figure 12:
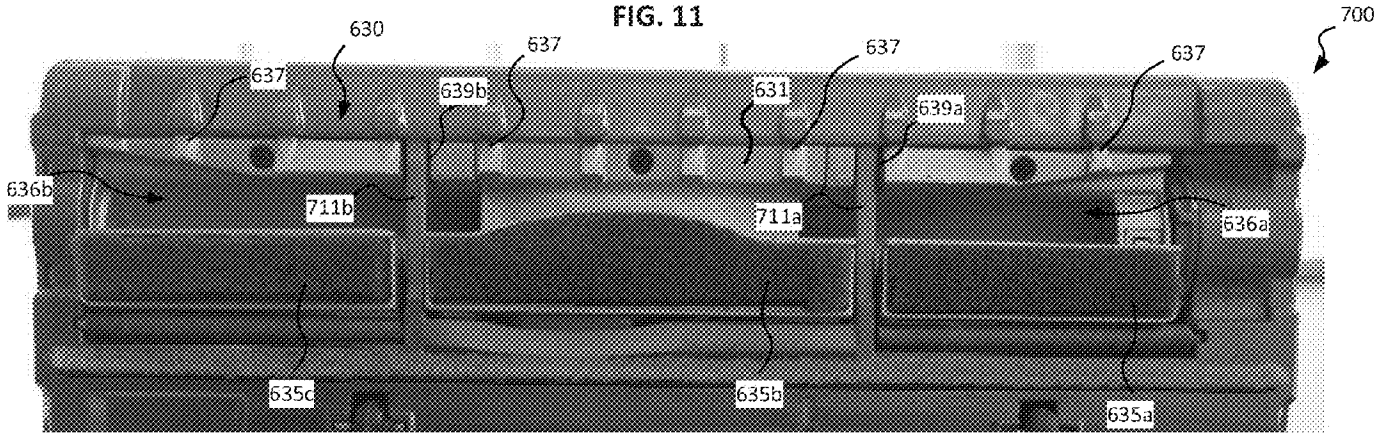
FIG. 12 is a bottom view of the surface cleaning head including the non-driven agitator shown in FIG. 11.

According to this embodiment of the surface cleaning head 700, the agitator chamber 720 is also configured to receive non-driven agitators, for example, as described above. As shown in FIGS. 11 and 12, the non-driven agitator 630 described above may be positioned within the agitator chamber 720 without engaging the drive mechanism 750. In this embodiment, the wing 631*a* at the end 632 of the agitator body 631 slides beneath a drive member 770 of the drive mechanism 750 and provides sufficient clearance for the drive member 770 to rotate without contacting the agitator 630. The bottom portion of the agitator body 631 has a width corresponding to a width of a bottom opening of the agitator chamber 720 (see FIG. 11).

When the non-driven agitator 630 is positioned within the agitator chamber 720, the air outlet 638 engages with a dirty air inlet 743 in the surface cleaning head 700 (see FIGS. 7A, 8 and 11) and the projections 637 on the bottom portion of the agitator body 631 are received in slots 713 along one side of the agitator chamber 720 (see FIGS. 8 and 12). Because of the resilience of the seal 639 around the air outlet 638, the projections 637 may fit tightly within the slots 713 such that the non-driven agitator 630 snaps into place within the agitator chamber 720. A force being applied by the resilient seal 639 thus holds the non-driven agitator 630 in place. When properly seated within the agitator chamber 720, the slots 713 receive the projections 637 with a friction fit, the spaces 639*a*, 639*b* on the bottom of the agitator body 631 receive the bottom guards or bars 711*a*, 711*b* extending across the bottom opening of the agitator chamber 720 and the cleaning pad(s) 635*a*-635*c* extend through the bottom opening of the agitator chamber 720 (see FIG. 12).

Figure 13:
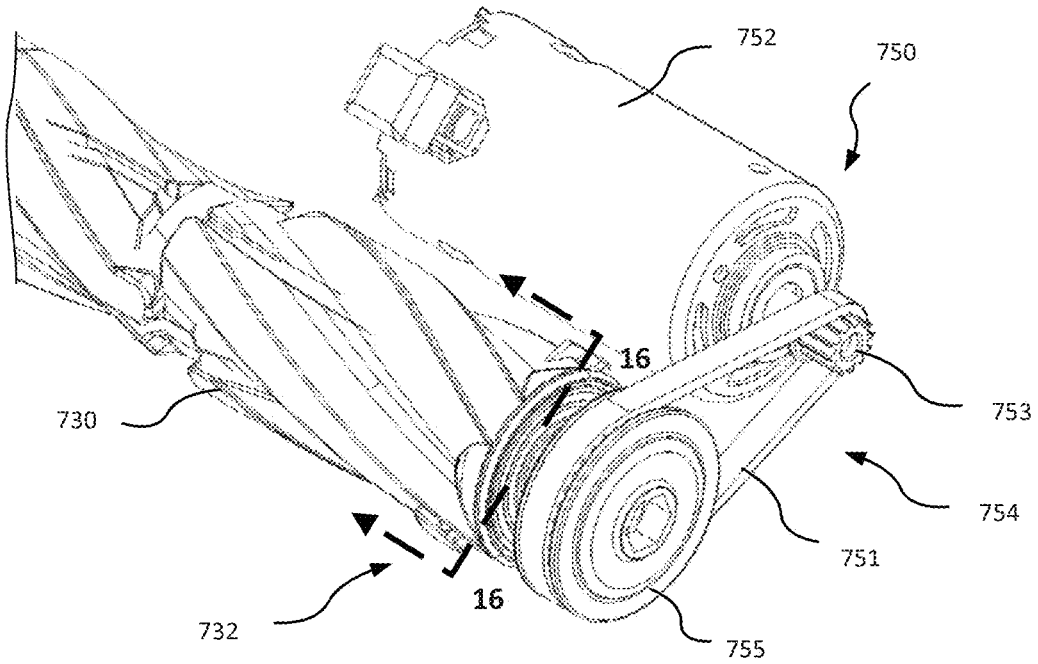
FIG. 13 is a top perspective view of an embodiment of a drive mechanism for use in the surface cleaning head shown in FIG. 10.
Figure 14:
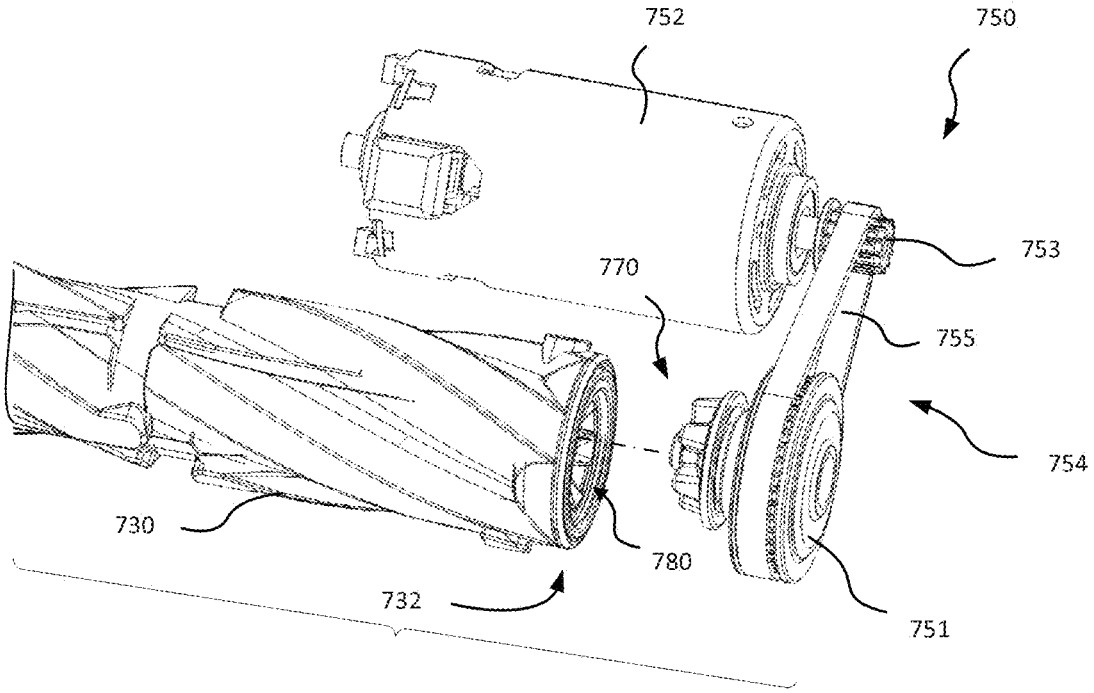
FIG. 14 is an exploded view of the drive mechanism shown in FIG. 13.

As shown in greater detail in FIGS. 13 and 14, the drive mechanism 750 includes a motor 752, a rotation transfer mechanism 754, and a splined drive member 770. In this embodiment, the rotation transfer mechanism 754 includes a belt 755 frictionally engaging a drive wheel 753 coupled to the output of the motor 752 and frictionally engaging a driven wheel 755 coupled to the splined drive member 770. The drive mechanism 750 may be capable of rotating the agitator 730 at low speeds of 700±100 RPM and high speeds of 3500±500 RPM. In other embodiments, other rotation transfer mechanisms may be used including, without limitation, a gear train or a direct drive coupling between the motor and the splined drive member. In other embodiments, a motor may be located internally within the rotatable agitator. In further embodiments, the drive mechanism may include other mechanisms capable of imparting rotation to the rotatable agitator including, without limitation, an air driven turbine.

Figure 15:
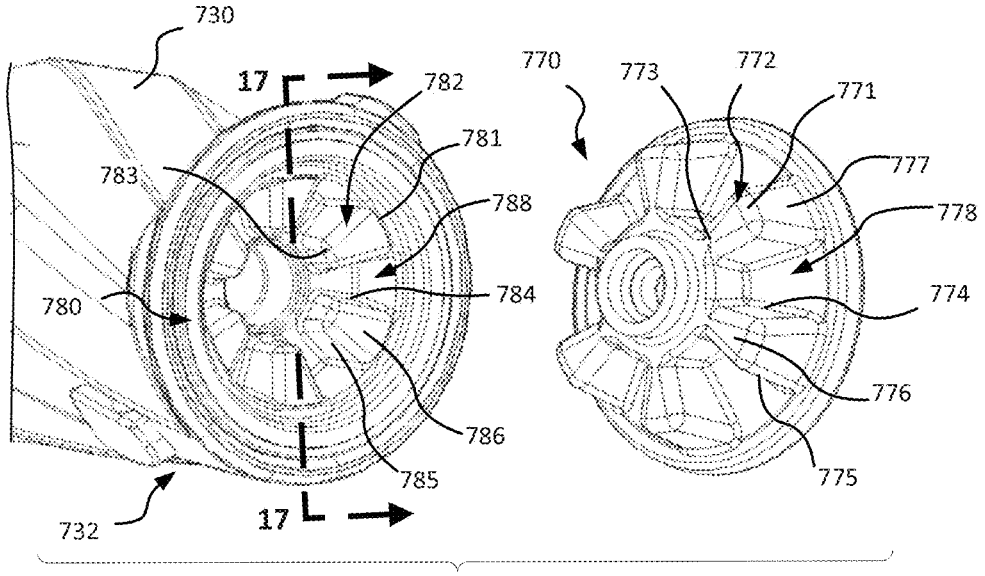
FIG. 15 is a close-up perspective view of a splined drive member and a splined driven member of the drive mechanism shown in FIG. 13.

As shown in greater detail in FIG. 15, the driven end 732 of the removable rotatable agitator 730 includes a splined driven member 780 configured to mate axially with the splined drive member 770. The splined drive member 770 and the splined driven member 780 thus form a spline coupling or joint that transmits rotation and torque without using a belt. The splined drive member 770 and the splined driven member 780 have spline teeth 772, 782 oriented radially relative to an axis of rotation of the agitator. The spline teeth 772, 782 have corresponding shapes and spaces 778, 788 between the spline teeth 772, 782 such that the spline teeth 772, 782 mesh when the members 770, 780 are axially engaged, as shown in FIG. 16.

The illustrated embodiment shows the splined drive member 770 with external splines and the splined driven member 780 with internal splines. In other embodiments, the splined drive member 770 may include the internal splines and the splined driven member 780 may include the external splines.

Figure 16:
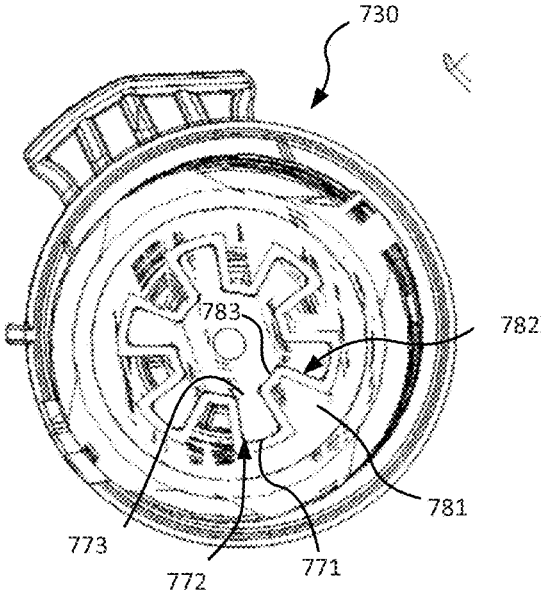
FIG. 16 is a cross-sectional view of a spline coupling between the splined drive member and the splined driven member taken along line 16-16 in FIG. 13.
Figure 17:
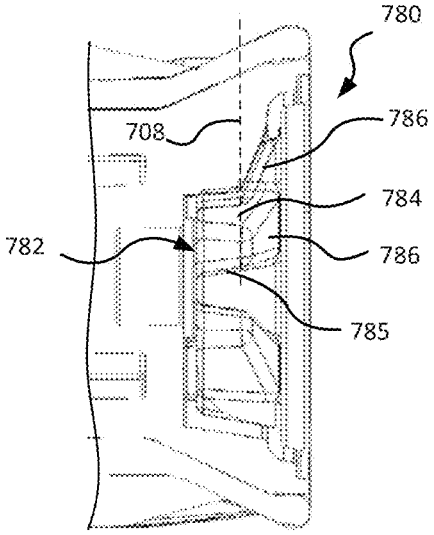
FIG. 17 is a side cross-section view of the splined driven member taken along line 17-17 in FIG. 15.

In the illustrated embodiment, the spline teeth 772, 782 on the splined drive member 770 and the splined driven member 780 are both generally wedge shaped with a radially outer portion 771, 781 being wider than a radially inner portion 773, 783 (see FIG. 16). The spline teeth 772, 782 also have tapered side walls 774, 775, 784, 785 that taper outwardly from radial faces 776, 786 of the spline teeth 772, 782. As shown in FIG. 17, the spline teeth 782 on the splined driven member 780 also have a tapered or chamfered radial face 786 that tapers inwardly (i.e., toward the non-driven end of the agitator) and forms an acute angle relative to a radial line 708 in a range of about 30° to 60°. The spline teeth 772 on the splined drive member 770 may have a tapered or chamfered axial face 777 that tapers inwardly toward the axis of rotation.

The shape and configuration of the spline teeth 772, 782 in the illustrated embodiment provide self-alignment and facilitate engagement of the splined driven member 780 with the splined drive member 770. The splined drive member 770 and the splined driven member 780 may be engaged in a number of different angular positions and thus do not require a precise angular alignment for engagement. The shape and configuration of the spline teeth 772, 782 in the illustrated embodiment may also reduce or eliminate backlash when the splined drive member 770 drives the splined driven member 780.

One or both of the splined driven member 780 and splined drive member 770 may also be made of an elastomeric material such as a thermoplastic rubber having a higher durometer (e.g., 90 or greater). The elastomeric material may facilitate engagement of the spline teeth 772, 782 and may provide vibration reduction or isolation when the splined drive member 770 drives the splined driven member 780. Thus, the drive mechanism 750 may rotate the agitator 730 at higher RPMs with reduced vibrations.

In the illustrated embodiment, each of the splined drive member 770 and the splined driven member 780 have six (6) spline teeth 772, 782 arranged in a star configuration around an axis of rotation. The six spline teeth are capable of withstanding the desired drive forces and torques while also facilitating alignment and preventing backlash; however, other numbers of spline teeth may be possible. Other shapes and configurations of the spline teeth on the splined drive member 770 and splined driven member 780 may also be possible. Furthermore, other couplings or mechanisms for axially coupling rotating shafts to transmit torque and rotation may also be used including, without limitation, a dog clutch, a non-slip clutch, a Hirth joint and a curvic coupling.

Figure 18:
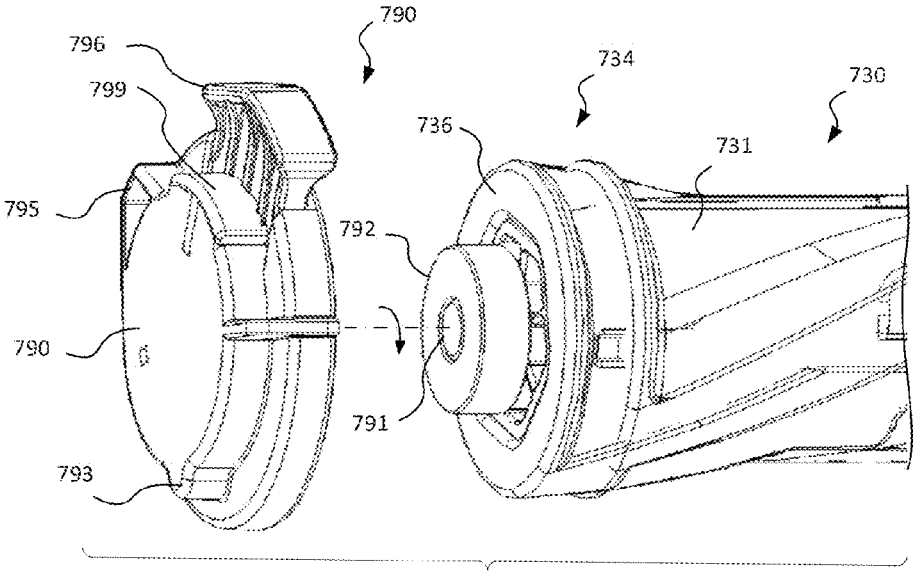
FIG. 18 is an exploded view of a non-driven end of an embodiment of a rotatable agitator for use in the surface cleaning head shown in FIG. 10.

As shown in greater detail in FIG. 18, the non-driven end 734 of this embodiment of the removable rotatable agitator 730 includes an end cap 790 secured to a bushing 792 that is rotatably mounted on an axle 791. The axle 791 is fixed within and extending from the agitator body 731. The end cap 790 is configured to be supported within the agitator chamber 720 and to secure the bushing 792 such that the axle 791 rotates within the bushing 792 and the rotatable agitator 730 spins about its axis of rotation. In this embodiment, the end cap 790 is removably secured to the bushing 792 with a friction fit but the end cap 790 may also fixed to the bushing 792. In other embodiments, the bushing 792 may be configured to be mounted directly within the agitator chamber 720 without an end cap. Various other configurations may also be used to rotatably support the non-driven end 734 of the rotatable agitator 730 within the agitator chamber 720.

Figure 19:
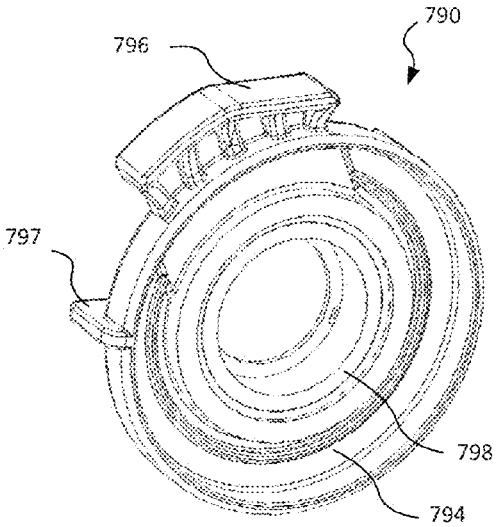
FIGS. 19 and 20 are different side perspective views of an embodiment of an end cap for use on the rotatable agitator shown in FIG. 18.
Figure 20:
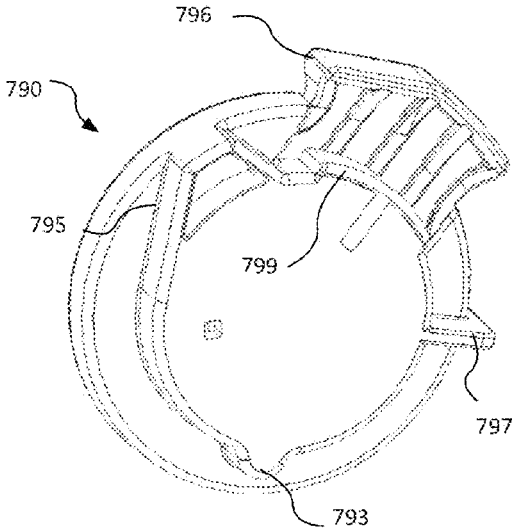

As shown in greater detail in FIGS. 19 and 20, the end cap 790 includes a tab 796 that is shaped to be easily gripped for removing the non-driven end 734 of the agitator 730 from the agitator chamber 720. The end cap 790 also includes one or more stabilizing structures 793, 795, 797 that engage mating structures within the agitator chamber to prevent the end cap 790 from rotating such that the bushing 792 is held stationary, thereby allowing the axle 791 to rotate freely within the bushing 792 when the rotatable agitator is driven at the driven end 732. This embodiment of the end cap 790 also includes an elastomeric pad 799 that engages the engaging structure 728 on the external cover 722 when the cover is closed to secure the agitator 730 in the agitator chamber 720. The end cap 790 further includes an elastomeric ring 798 to frictionally engage the bushing 792. The elastomeric pad 799 and the elastomeric ring 798 may advantageously prevent or isolate vibrations when the agitator 730 is rotating in the agitator chamber 720 and may both be molded together from the same rubber material. The end cap 790 may further include a washer 794 (e.g., a felt washer) that contacts an end surface 736 of the agitator body 731 to keep dirt away from the bearing 792.

Figure 21:
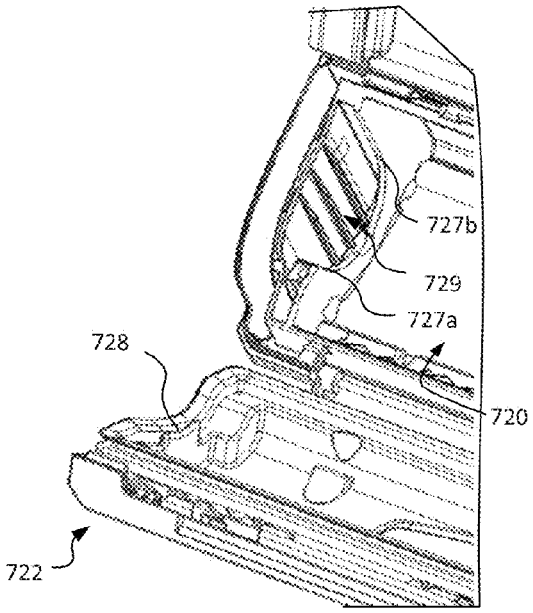
FIG. 21 is a top perspective view of a non-driven side of the agitator chamber in the surface cleaning head of FIG. 10 without the rotatable agitator.
Figure 22:
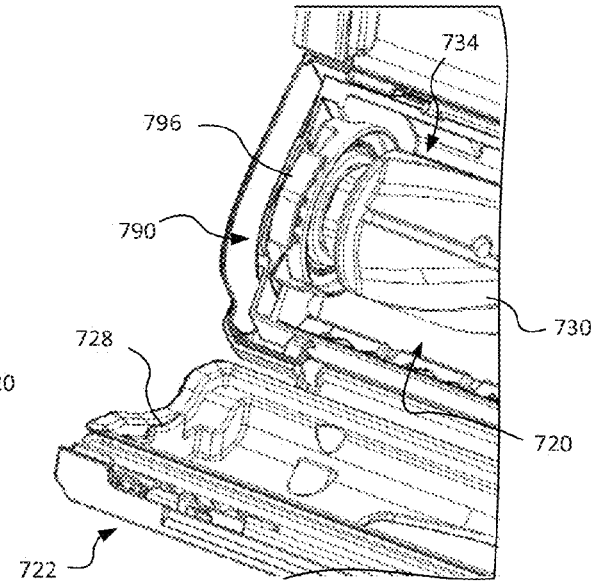
FIG. 22 is a top perspective view of the non-driven side of the agitator chamber in the surface cleaning head of FIG. 10 with the non-driven end of the rotatable agitator received therein.
Figure 23:
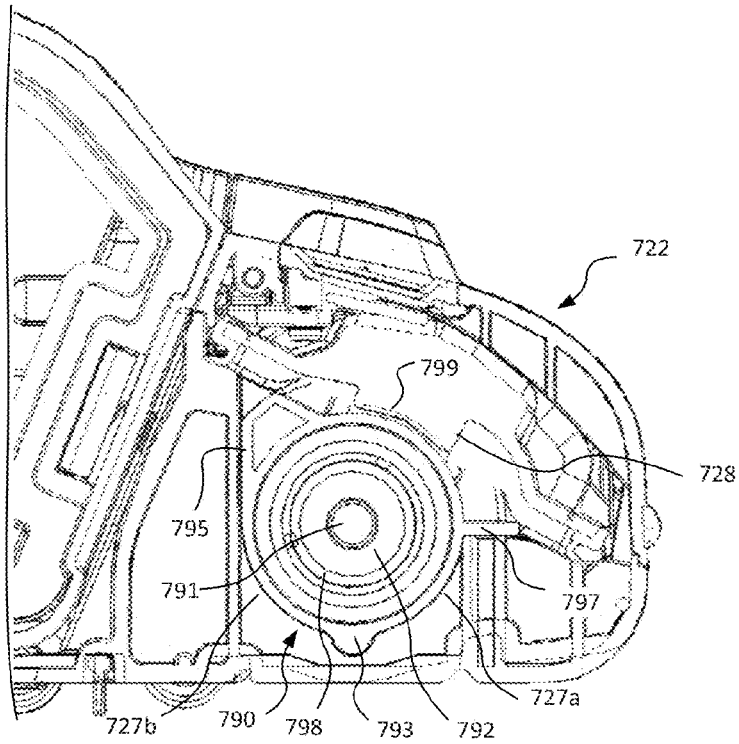
FIG. 23 is a cross-sectional view of the end cap of the agitator seated in the agitator chamber in the surface cleaning head of FIG. 10 with the cover closed.

Referring to FIGS. 21-23, the engagement of the end cap 790 with the agitator chamber 720 is described in greater detail. At the non-driven side, the chamber 720 includes mounting rails 727*a*, 727*b* defining a recessed region 729 that receives an end portion of the end cap 790. The end portion of the end cap 790 may thus slide between the mounting rails 727*a*, 727*b* as shown in FIG. 22. As shown in FIG. 23, the stabilizing structures 793, 795, 797 engage corresponding structures on the mounting rails 727*a*, 727*b* and the engaging structure 728 inside of the cover 722 engages the elastomeric pad 799. Thus, the end cap 790 and the bushing 792 remain stationary when the agitator 730 is rotated. Additionally or alternatively, the cover 722 may engage other portions of the end cap 790 (e.g., the tab 796) to hold the end cap 790 in the chamber 720. In this embodiment, the stabilizing structures 793, 795, 797 have a particular configuration designed or keyed to mate with the mounting rails 727*a*, 727*b* (see FIG. 23) in a particular orientation such that the end cap 790 is properly positioned to be engaged by the cover 722.

To mount the rotatable agitator 730 within the agitator chamber 720, the driven end 732 is angled into the chamber 720 to engage the splined drive member 770 with the splined driven member 780 (see FIG. 16). The end cap 790 may then be used to lower the non-driven end 734 of the agitator 730 into the chamber 720 until the end cap 790 is fit between the mounting rails 727*a*, 727*b* (see FIG. 22). When the agitator 730 is properly seated within the chamber 720, the external cover 722 may then be closed to cover the chamber 720 and to secure the rotatable agitator 730 within the chamber 720. To remove the rotatable agitator 730, the user may grasp the tab 796 to slide the end cap 790 out from between the mounting rails 727*a*, 727*b* and thus lift the non-driven end 734 out of the chamber 720. The user may then continue to lift the agitator 730 until the splined drive member 770 and the splined driven member 780 are disengaged. The user may then clean the agitator 730 and/or insert another type of agitator.

Figure 24:
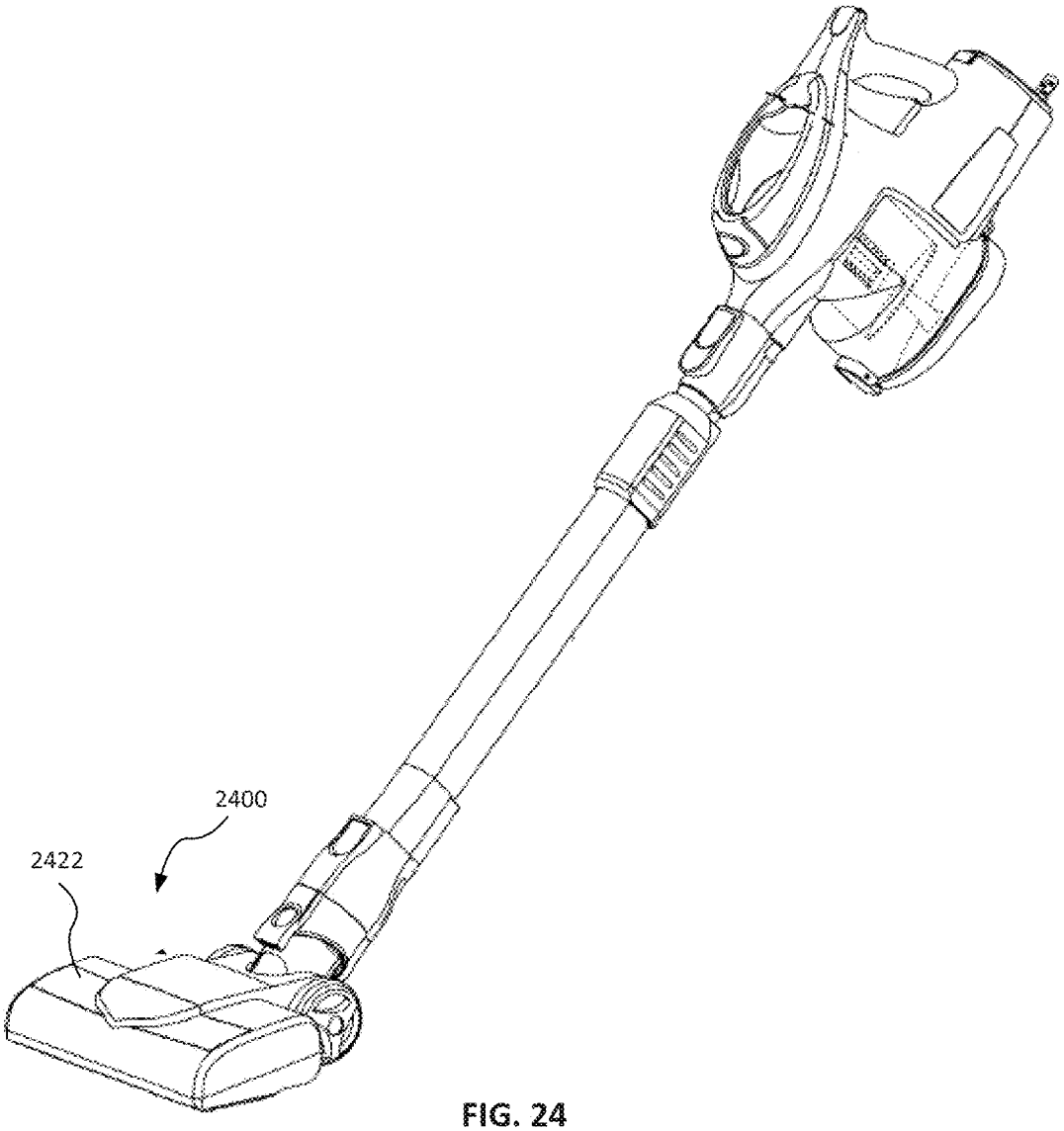
FIG. 24 is a perspective view of a stick vacuum cleaner including a cleaning head with an openable agitator chamber, consistent with a further embodiment of the present disclosure.

Referring to FIG. 24, a surface cleaning head 2400 of a stick vacuum cleaner may include an openable agitator chamber covered by an external cover 2422 and containing a removable agitator. The external cover 2422 and the openable chamber and removable agitator located in the surface cleaning head 2400 may be implemented according to any of the embodiments described herein.

Figure 25:
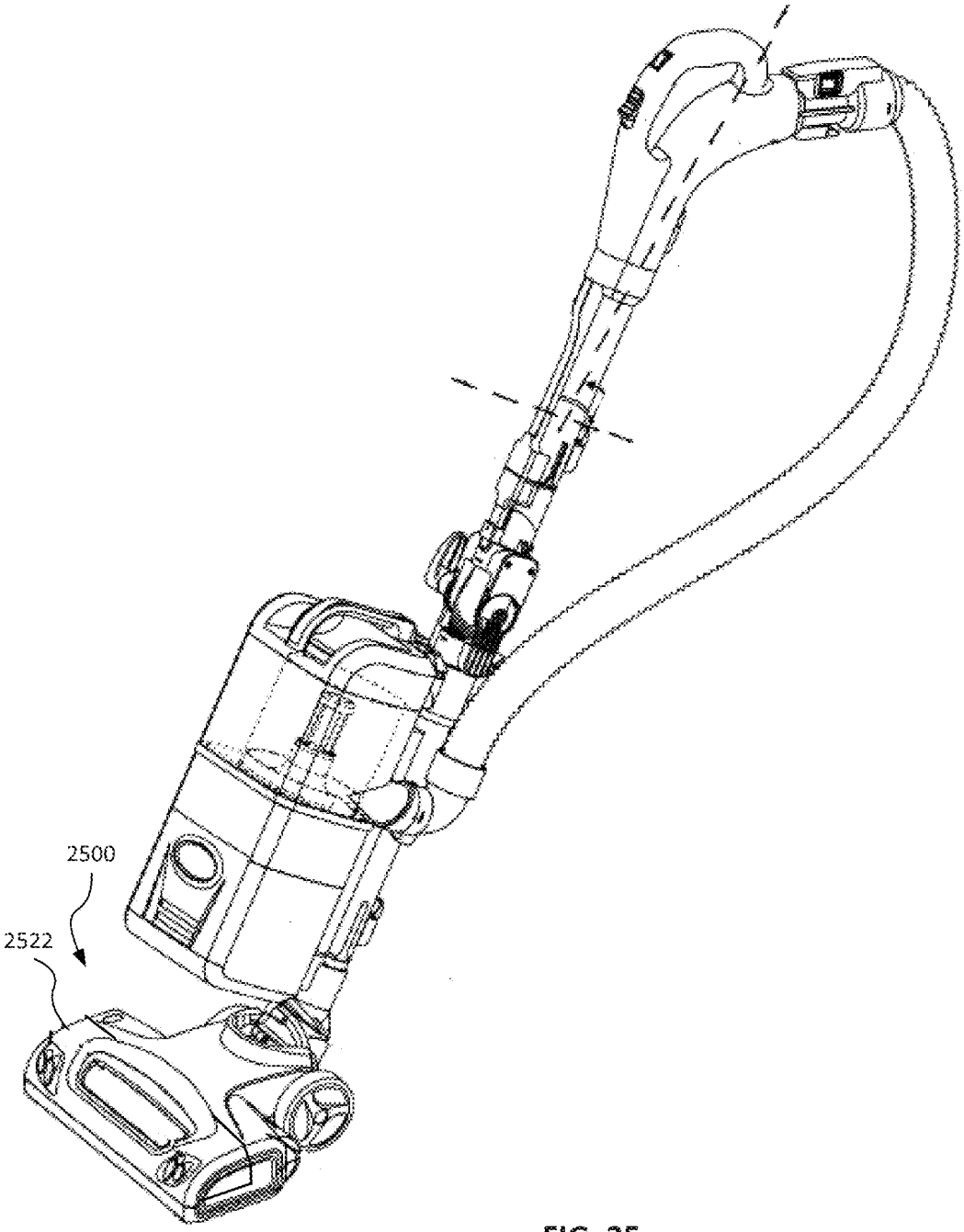
FIG. 25 is a perspective view of an upright vacuum cleaner including a cleaning head with an openable agitator chamber, consistent with yet another embodiment of the present disclosure.

Referring to FIG. 25, a surface cleaning head 2500 of an upright vacuum cleaner may include an openable agitator chamber covered by an external cover 2522 and containing a removable agitator. The external cover 2522 and the openable chamber and removable agitator located in the surface cleaning head 2500 may be implemented according to any of the embodiments described herein.

Accordingly, a surface cleaning head, consistent with embodiments of the present disclosure, includes an openable agitator chamber to facilitate inspection, cleaning, servicing, and/or replacement of an agitator in the surface cleaning head. The removable agitator may include a rotatable driven agitator that engages a drive mechanism in the agitator chamber or a non-rotatable, non-driven agitator that is received within the agitator without engaging the drive mechanism.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. It will be appreciated by a person skilled in the art that a surface cleaning apparatus may embody any one or more of the features contained herein and that the features may be used in any particular combination or sub-combination. Modifications and substitutions by one of ordinary skill in the art are considered to be within the scope of the present invention, which is not to be limited except by the following claims.

What is claimed is:

1. A surface cleaning head for a vacuum, the surface cleaning head comprising:

a cleaning head housing having a front end portion, a rear end portion, laterally disposed sides, an upper portion and a bottom portion;

an agitator chamber located in the front end portion of the cleaning head housing, the agitator chamber having a top opening through the upper portion of the cleaning head housing and a bottom opening through the bottom portion of the cleaning head housing, and wherein the agitator chamber includes at least one driven side;

an agitator drive mechanism including a drive member at the driven side of the agitator chamber and an agitator drive motor drivingly coupled to the drive member, wherein the drive member is configured to engage and drive a rotatable driven agitator when received in the agitator chamber;

an external cover mounted to the cleaning head housing for covering the top opening of the agitator chamber, the external cover being movable between a closed position and an open position, wherein the agitator chamber is covered when the external cover is in the closed position and accessible through the top opening when the external cover is in the open position; and a non-driven agitator removably mounted within the agitator chamber without engaging the drive member such that the non-driven agitator is configured to contact a surface through the bottom opening, wherein the non-driven agitator is accessible and removable through the top opening when the external cover is in the open position.

2. The surface cleaning head of claim 1 wherein the non-driven agitator includes an agitator body and at least one cleaning pad supported on a pad support member on a bottom portion of the agitator body, wherein the at least one cleaning pad is configured to contact the surface through the bottom opening.

3. The surface cleaning head of claim 2 wherein the at least one cleaning pad includes at least one fabric pad.

4. The surface cleaning head of claim 2 wherein the at least one cleaning pad includes at least one felt pad.

5. The surface cleaning head of claim 2 wherein the at least one cleaning pad includes at least one brush pad.

6. The surface cleaning head of claim 2 wherein the at least one cleaning pad is removably attached to the pad support member.

7. The surface cleaning head of claim 2 wherein the agitator body of the non-driven agitator defines at least one air inlet adjacent the at least one cleaning pad, at least one air outlet and an air path between the at least one air inlet and the air outlet, wherein the air outlet is fluidly coupled to a dirty air inlet in the agitator chamber of the surface cleaning head.

8. The surface cleaning head of claim 7 wherein the at least one air inlet includes first and second elongated air inlets and the at least one air outlet includes a single air outlet, wherein the first and second elongated air inlets extend along at least a portion of the bottom portion of the agitator body.

9. The surface cleaning head of claim 7 wherein the at least one air outlet includes a seal around a periphery thereof.

10. The surface cleaning head of claim 2 wherein the bottom portion of the agitator body includes a plurality of projections on a side opposite the pad support member, the projections being configured to engage associated slots on a side of the bottom opening of the agitator chamber.

11. The surface cleaning head of claim 1 wherein the bottom portion of the agitator body includes at least one space for receiving bars extending across the bottom opening of the agitator chamber.

12. A surface cleaning head for a vacuum, the surface cleaning head comprising:

a cleaning head housing having a front end portion, a rear end portion, laterally disposed sides, an upper portion and a bottom portion;

an agitator chamber located in the front end portion of the cleaning head housing, the agitator chamber having a top opening through the upper portion of the cleaning head housing and a bottom opening through the bottom portion of the cleaning head housing, and wherein the agitator chamber includes at least one driven side;

an agitator drive mechanism including a drive member at the driven side of the agitator chamber and an agitator drive motor drivingly coupled to the drive member;

at least one rotatable driven agitator configured to be removably mounted within the agitator chamber and configured to engage the drive member of the agitator drive mechanism such that the drive member causes the rotatable driven agitator to rotate; and at least one non-driven agitator configured to be removably mounted within the agitator chamber without engaging the drive member and such that the non-driven agitator is configured to contact a surface through the bottom opening.

13. The surface cleaning head of claim 12 wherein the rotatable driven agitator includes a brush roll.

14. The surface cleaning head of claim 12 wherein the rotatable driven agitator includes:

an agitator body having a driven end and a non-driven end;

at least one agitating element located on at least a portion of the agitator body between the driven end and the non-driven end;

a driven member located at the driven end of the agitator body, the driven member being configured to mate axially and engage with a drive member on a drive mechanism in the surface cleaning head; and an end cap mounted on at the non-driven end of the agitator body and configured to be mounted without rotation in the agitator chamber of the surface cleaning head.

15. The surface cleaning head of claim 14 wherein the end cap includes a tab extending radially and configured to be gripped by a user to facilitate removing and inserting the non-driven end into the agitator chamber.

16. The surface cleaning head of claim 12 wherein the non-driven agitator includes an agitator body and at least one cleaning pad supported on a pad support member on a bottom portion of the agitator body, wherein the at least one cleaning pad is configured to contact the surface through the bottom opening.

17. The surface cleaning head of claim 16 wherein the at least one cleaning pad includes at least one of a fabric pad, a felt pad or a brush pad.

18. The surface cleaning head of claim 16 wherein the at least one cleaning pad is removably attached to the pad support member.

19. The surface cleaning head of claim 16 wherein the body of the non-driven agitator defines at least one air inlet adjacent the at least one cleaning pad, at least one air outlet and an air path between the at least one air inlet and the air outlet, wherein the air outlet is configured to be fluidly coupled to a dirty air inlet in the agitator chamber of the surface cleaning head.

20. The surface cleaning head of claim 19 wherein the at least one air inlet includes first and second elongated air inlets and the at least one air outlet includes a single air outlet, wherein the first and second elongated air inlets extend along at least a portion of the bottom portion of the agitator body.

21. The surface cleaning head of claim 19 wherein the at least one air outlet includes a seal around a periphery thereof.

22. A removable non-driven agitator for use in an agitator chamber of a surface cleaning head, the removable non-driven agitator comprising:

an agitator body defining first and second elongated air inlets, an air outlet, and an air path between at least one of the air inlets and the air outlet, the elongated air inlets being located along at least a portion of a bottom portion of the agitator body, the air outlet being located on the agitator body at a position to provide engagement with a dirty air inlet in the agitator chamber of the surface cleaning head, the bottom portion of the agitator body having a width corresponding to a width of a bottom opening of the agitator chamber, wherein first and second ends of the agitator body are configured to engage the agitator chamber without engaging a drive member in the agitator chamber;

at least one cleaning pad supported on a pad support member on at least one side of the bottom portion of the agitator body; and a seal around the air outlet.

23. The removable non-driven agitator 22 further comprising a plurality of projections on an opposite side of the bottom portion, the projections being configured to engage associated slots on one side of the agitator chamber.

24. The removable non-driven agitator of claim 22 wherein the agitator body further includes at least one wing extending from at least one of the first and second ends of the agitator body, wherein the wing is configured to fit under the drive member in the agitator chamber.

25. The removable non-driven agitator of claim 22 wherein the cleaning pad includes a felt pad.

26. The removable non-driven agitator 22 wherein the cleaning pad includes a felt pad.

27. The removable non-driven agitator 22 wherein the cleaning pad includes a brush pad.

28. The removable non-driven agitator 22 wherein the bottom portion of the agitator body includes at least one space for receiving bars extending across the bottom opening of the agitator chamber.

29. The removable non-driven agitator 22 wherein the at least one cleaning pad is removably attached to the cleaning pad support.

* * * * *